US006262531B1

(12) United States Patent
Inoguchi et al.

(10) Patent No.: US 6,262,531 B1
(45) Date of Patent: Jul. 17, 2001

(54) THIN-FILM EL DISPLAY PANEL HAVING UNIFORM DISPLAY CHARACTERISTICS

(75) Inventors: Kazuhiro Inoguchi, Toyota; Nobuei Ito, Chiryu; Tadashi Hattori; Yutaka Hattori, both of Okazaki; Masahiko Osada, Hekinan, all of (JP)

(73) Assignee: Nippondenso Co., Ltd., Kariya (JP)

( * ) Notice: Subject to any disclaimer, the term of this patent is extended or adjusted under 35 U.S.C. 154(b) by 0 days.

(21) Appl. No.: 09/187,454

(22) Filed: Nov. 5, 1998

Related U.S. Application Data

(62) Division of application No. 08/414,093, filed on Mar. 31, 1995, now Pat. No. 5,883,465.

(30) Foreign Application Priority Data

Mar. 31, 1994 (JP) ..... 6-63096

(51) Int. Cl.[7] ..... H01J 1/62

(52) U.S. Cl. ..... 313/506; 313/500; 313/505; 313/509

(58) Field of Search ..... 313/506, 509, 313/505, 500, 512; 428/690, 917

(56) References Cited

U.S. PATENT DOCUMENTS

| | | | | |
|---|---|---|---|---|
| 4,801,844 | * | 1/1989 | Barrow et al. | 313/509 |
| 4,829,213 | | 5/1989 | Pecile et al. . | |
| 4,914,348 | | 4/1990 | Kameyama et al. . | |
| 4,945,009 | * | 7/1990 | Taguchi et al. | 428/690 |
| 4,954,746 | | 9/1990 | Taniguchi et al. . | |
| 4,977,350 | | 12/1990 | Tanaka et al. . | |
| 5,483,120 | | 1/1996 | Murakami . | |
| 5,965,980 | * | 10/1999 | Hagiwara et al. | 313/506 |
| 6,140,765 | * | 10/2000 | Kim et al. | 313/506 |

FOREIGN PATENT DOCUMENTS

| | | |
|---|---|---|
| 59-133584 | 7/1984 | (JP) . |
| 64-6398 | 1/1989 | (JP) . |
| 5102633 | 4/1993 | (JP) . |
| 5145209 | 6/1993 | (JP) . |

* cited by examiner

*Primary Examiner*—Ashok Patel
*Assistant Examiner*—Karabi Guharay
(74) *Attorney, Agent, or Firm*—Pillsbury Winthrop LLP

(57) ABSTRACT

A thin-film EL display panel which has excellent packageability, high reliability and stable performance characteristics, and which can prevent nonuniformity of brightness and color from occurring and a fabrication method thereof are provided. In the above thin-film EL display panel, two thin-film EL elements 1 and 2 formed by sequentially laminating first electrodes 12 and 22, first insulating layers, luminescent layers, second insulating layers and second electrodes 16 and 26 respectively on glass substrates 11 and 21 are laminated into position and connecting terminal portions 12*a*, 22*a*, 16*a* and 26*a* for connecting the first electrodes 12 and 22 and second electrodes 16 and 26 are formed on the edge portions of the substrates 11 and 21 of the thin-film EL elements 1 and 2. connecting pad portions 17 and 18 which correspond respectively to the connecting terminal portions 22*a* and 26*a* of the thin-film EL element 2 are provided on the edge portions on the substrate of the thin-film EL element 1, the connecting pad portions are connected to the connecting terminal portions of the other thin-film EL element via conductive coupling sections 19 and the connecting pad portions and the connecting terminal portions to which lead wires are connected are provided on the edge portion of one substrate at a position where both substrates will not be laminated.

15 Claims, 15 Drawing Sheets

THIN-FILM EL DISPLAY PANEL HAVING UNIFORM DISPLAY CHARACTERISTICS

This is a division of application Ser. No. 08/414,093 filed Mar. 31, 1995 now U.S. Pat. No. 5,883,465.

BACKGROUND OF THE INVENTION

1. Field of the Invention

The present invention relates to a thin-film EL (electroluminescent) display panel used in a display unit of various types of information terminals and for an indicator mounted in cars, and more particularly to a thin-film EL display panel structured by laminating two thin-film EL elements and to a method of fabricating the same.

2. Description of the Related Art

A thin-film EL display panel utilizes a phenomenon whereby light is emitted when an electric field is applied to a phosphor having zinc sulfide (ZnS) or the like as its base material.

Luminescent colors of this type of thin-film EL display panel may be changed in various ways by changing the type of luminescent central elements doped within the luminescent layer. For example, when manganese (Mn) is doped into zinc sulfide (ZnS) as the luminescent base material, the luminescent layer emits orange-colored light. It also emits green, red, blue and white light, respectively, when terbium fluoride ($TbF_3$), samarium chloride ($SmCl_3$), thulium chloride ($TmCl_3$) and praseodymium fluoride ($PrF_3$) are doped into ZnS.

Then, a thin-film EL display panel in which thin-film EL elements, each of which emits a different color, are formed on two substrates, wherein at least one substrate is transparent, and the EL elements are laminated and bonded to allow the device to display varying colors has been proposed (see, e.g., Japanese Patent Publication Laid-Open No. Sho. 59-133584).

Because this variable color thin-film EL display panel may be constructed simply by laminating monochromatic double insulating type thin-film EL elements, its structure is relatively simple. Furthermore, because the EL elements, each having a different luminescent color, may be selected and checked before final assembly, the yield of the product is good and its reliability is high.

While the thin-film EL display panel is generally apt to deteriorate due to airborne moisture and the like, in order to protect it, the whole EL element is sealed by silicon oil or the like. The variable color thin-film EL display panel described above has also another advantage in that it requires no dummy substrate for sealing because the EL elements are laminated while facing each other and silicon oil or the like may be sealed in the space formed therebetween.

However, the thin-film EL display panel constructed by laminating two thin-film EL elements has a problem as described below. Because lead wires have to be connected to connecting terminal portions of electrodes on each separated substrate, the packaging and assembling process including the lead connection becomes very complicated and cumbersome when a large number of connecting terminal portions are provided at the periphery of the substrate. Due to that, a lead connection structure for a thin-film EL display panel structured by laminating two thin-film EL elements together was proposed in Japanese Patent Publication Laid-Open No. Sho. 64-60993.

As shown in FIG. 25, in the above-described prior art thin-film EL display panel, each of connecting terminals 92 and 93 is connected to a lead wire member 94 by providing the terminal portions 92 and 93 of each electrode of two thin-film EL elements 90 and 91 at the periphery of the elements, laminating both thin-film EL elements 90 and 91 to form a very small gap therebetween and inserting each lead wire member 94, which may be, for example, a flexible printed circuit board (FPC), in the small gap with layers of electrical insulation disposed between opposed lead wire members 94 as shown in FIG. 25. However, the width of the gap between the two thin-film EL elements 90 and 91 can be as small as about 50 $\mu$m, and it is actually impossible to connect the lead wire member 94 after laminating the two thin-film EL elements 90 and 91 together.

Due to that, although it is necessary to connect the lead wire members 94 to each connecting terminal portion 92 and 93 before laminating the EL elements 90 and 91 together, it is very difficult to accurately position and bond the two substrates 90 and 91 together after attaching the lead wire members 94. Furthermore, when silicon oil fills the gap between the EL elements 90 and 91 to prevent moisture after that, the oil adheres to the lead wire member 94 and it is difficult to clean it.

Furthermore, when an FPC is used as the lead wire member 94, although it is necessary to widen the gap between the two thin-film EL elements 90 and 91 from 200 $\mu$m to 400 $\mu$m in order to dispose two FPCs in the gap since the thickness of the board is normally 100 $\mu$m to 200 $\mu$m, there has been a problem in that when both thin-film EL elements 90 and 91 are bonded together while widening the gap therebetween, the displayed color of the variable color display is likely to blot or blur, thereby degrading the display quality.

Meanwhile (although this technique is not prior art to the present invention), in the case of a dot-matrix type thin-film EL display panel, it is possible to laminate and bond two EL elements 95 and 96 together while shifting them and to connect the lead wire member after sealing with silicon oil as shown in FIG. 26 in order to avoid the problem of the connection of the lead wire member described above.

In the case of such a thin-film EL display panel, however, because connecting terminal portions 97 and 98 of each strip electrode of each of the thin-film EL elements 95 and 96 are located on one side of the electrode, the distance from each light emitting display dot (the intersection of the strip electrodes) 99 to each of the connecting terminal portions 97 and 98 largely differs depending on the position of each display dot.

Due to that, when using a transparent electrode material such as indium-tin oxide (ITO) having a relatively large resistance, a voltage and current between the connecting portions 97 and 98 and the display dot are large near the connecting terminal portions 97 and 98 and the farther the distance therefrom, the lower the current and voltage between the electrodes becomes, causing nonuniformity of brightness on the display screen of such a thin-film EL display panel.

Furthermore, in the case of the variable color thin-film EL display panel in which two thin-film EL elements each having a different luminescent color are laminated together, because the luminescent color of each element is controlled by changing a voltage signal or the like applied to each thin-film EL element and an attempt is made to display a predetermined color, the composite display color varies depending on the position of a particular pixel on the display screen, thus causing nonuniformity of the overall display color.

SUMMARY OF THE INVENTION

Accordingly, it is an object of the present invention to solve the aforementioned problems by providing a thin-film EL display panel and a manufacturing method thereof which has an excellent packageability, is highly reliable and exhibits stable performance and can prevent a nonuniformity in the brightness and color of the display.

In order to achieve the aforementioned object, a thin-film EL display panel according to the present invention in which two thin-film EL elements formed by sequentially laminating first electrodes, first insulating layers, luminescent layers, second insulating layers and second electrodes respectively on glass substrates are laminated into position and connecting terminal portions for connecting the first and second electrodes are formed on the edge portions of the substrates of each thin-film EL element is constructed by providing connecting pad portions which correspond respectively to the connecting terminal portions of the other thin-film EL element on the edge portions on the substrate of one thin-film EL element, by connecting the connecting pad portions with the connecting terminal portions of the other thin-film EL element via conductive coupling sections and by providing the connecting pad portions and the connecting terminal portions to which lead wires are connected on the edge portion of one substrate at a position where both substrates will not be laminated.

Preferably, both thin-film EL elements may be constructed so that each of the first and second electrodes are provided in parallel and that the connecting terminal portions of the first electrode or the second electrode of both thin-film EL elements positioned overlapping one another are provided on the edge portion of the same side.

Because the connecting pad portions and connecting terminal portions where the lead wires such as FPCs are connected are provided at positions where the substrates of both thin-film EL elements do not overlap, the connection of the lead wire may be made after packaging and assembly, i.e. after laminating and bonding the thin-film EL elements and after filling in insulating oil, thereby allowing for a great deal of simplification of the lead wire connecting works in comparison with prior art systems. Further, because two thin-film EL elements may be positioned and bonded with a small gap therebetween with a great deal of accuracy, a high quality display which has no obscurity or blurriness can be made.

Furthermore, because the connecting terminal portions of the first and second electrodes of both thin-film EL elements positioned overlapping from one another are provided respectively on the edge portions on the same side, each lead wire of the first electrode and second electrode of both thin-film EL elements on that part is connected from the same direction, so that when the thin-film EL display panel is actually driven, each electrode of the overlapping two thin-film EL element electrodes is fed mutually from the same direction. Due to that, the nonuniformity of brightness caused by the difference of the electrical resistances of the electrodes which is brought about by the difference of distances from the connecting terminal portion to the display portion in each electrode may be eliminated. Furthermore, by the same reason, the nonuniformity of color which occurs in the variable color thin-film EL display panel in which two thin-film EL elements having different luminescent colors are laminated may be eliminated.

The above and other related objects and features of the present invention will be apparent from a reading of the following description of the disclosure found in the accompanying drawings and the novelty thereof pointed out in the appended claims.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DETAILED DESCRIPTION OF PREFERRED EMBODIMENTS

Figure 1:
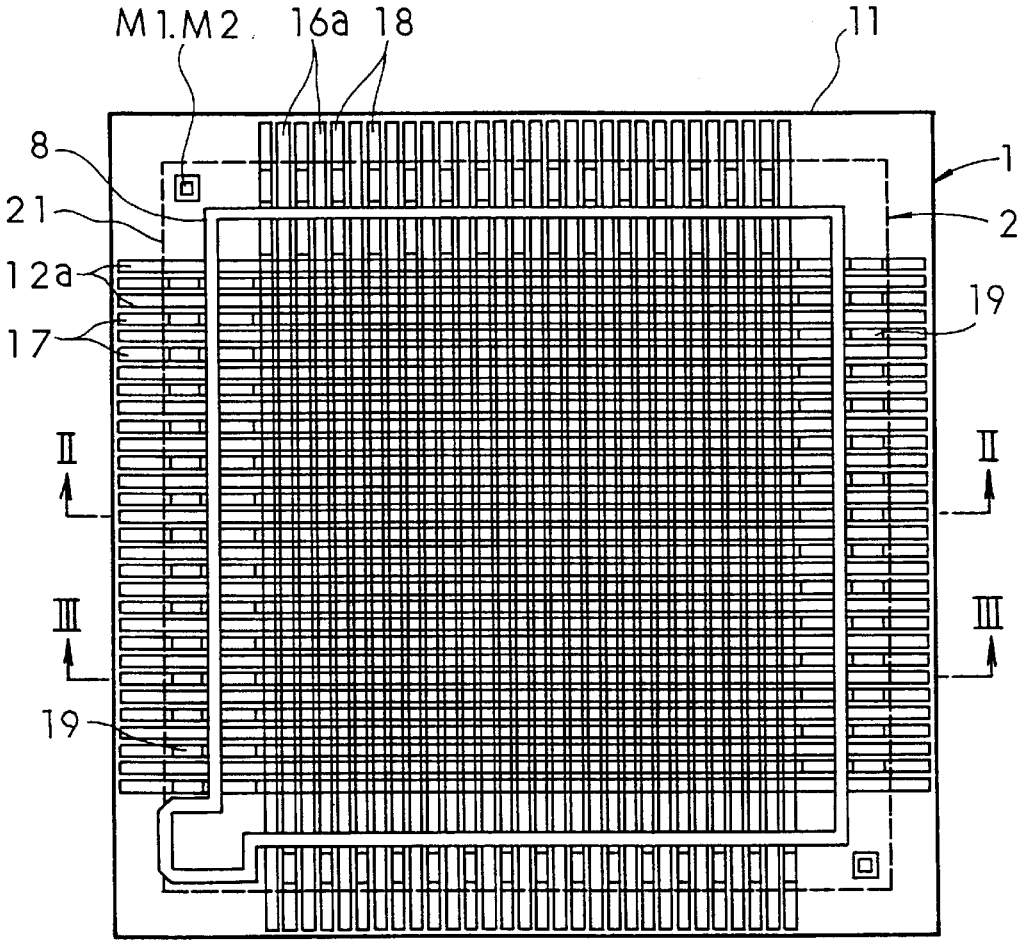
FIG. 1 is a schematic plan view of a variable color thin-film EL display panel showing a first embodiment of the present invention.

Referring now to the drawings, preferred embodiments of the present invention will be explained.

Figure 2:
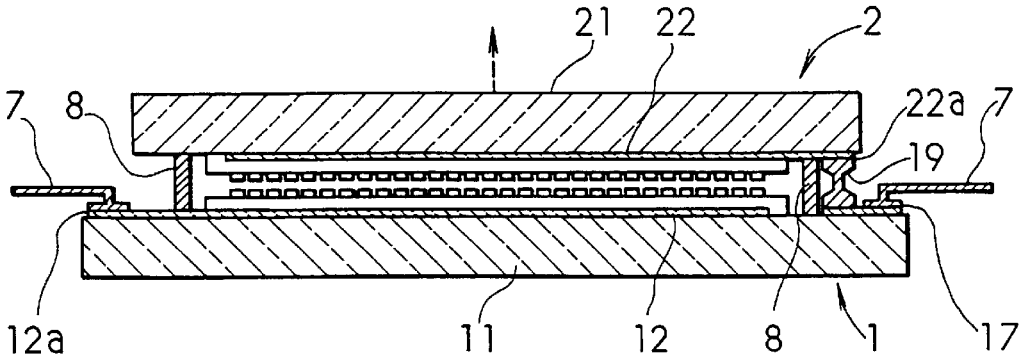
FIG. 2 is a schematic cross-sectional view along a line II—II in FIG. 1.
Figure 3:
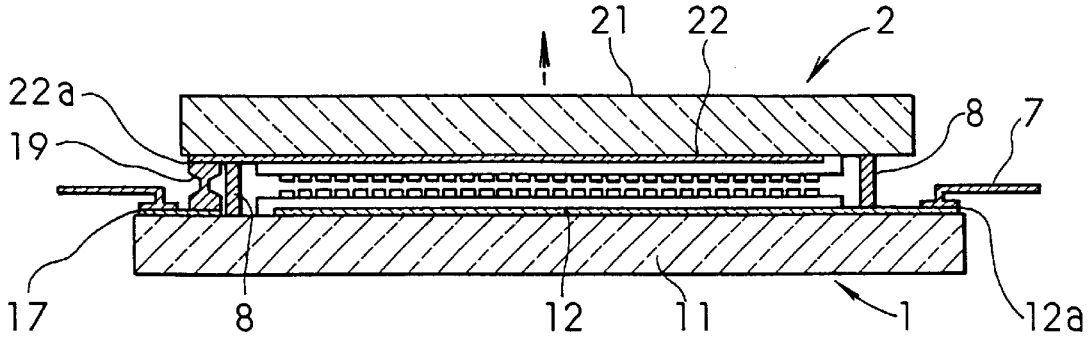
FIG. 3 is a schematic cross-sectional view along a line III—III in FIG. 1.

FIG. 1 is a schematic plan view of a dot matrix type variable color thin-film EL display panel, and FIGS. 2 and 3 are schematic cross-sectional views thereof.

This variable color thin-film EL display panel is constructed by laminating and bonding a smaller thin-film EL element 2 (shown more clearly in FIG. 5) on a thin-film EL element 1 (shown more clearly in FIG. 4) so that their luminescent layers face each other.

Figure 6:
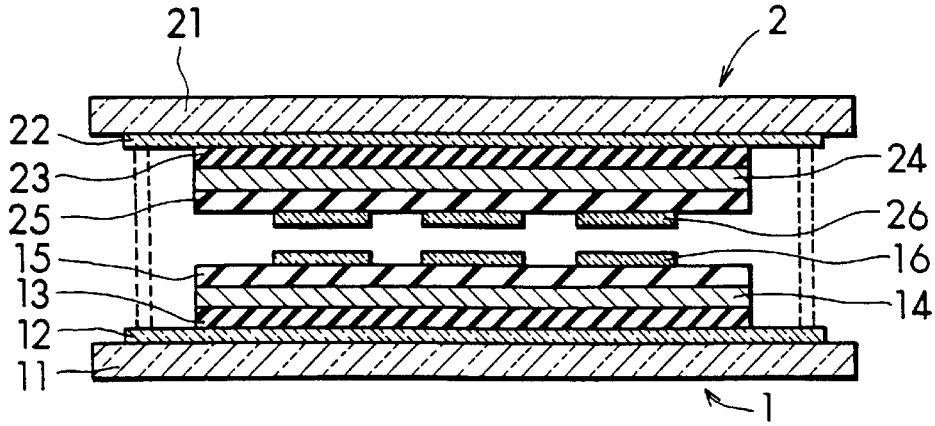
FIG. 6 is a schematic cross-sectional view of the thin-film EL display panel.

As shown in FIG. 6, the thin-film EL element 2 is constructed by sequentially laminating, on a non-alkali glass substrate 21 which is a translucent insulating substrate, a first transparent electrode 22 made from an ITO transparent conductive film, a first insulating layer 23, a luminescent layer 24 whose base material is zinc sulfide (ZnS) and which emits light having a first luminescent color, a second insulating layer 25 and a second transparent electrode 26 made from a zinc oxide ($ZnO:Ga_2O_3$) transparent conductive film.

Figure 5:
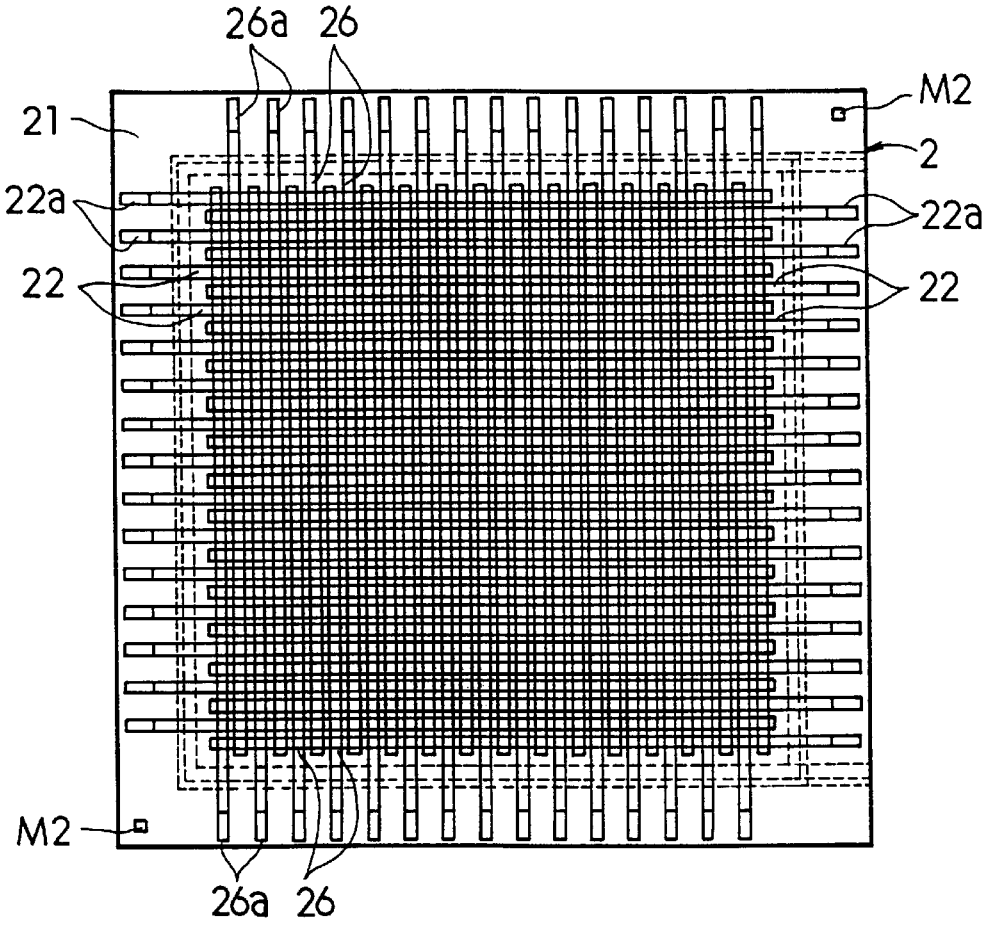
FIG. 5 is a schematic plan view of a thin-film EL display panel 2.

As shown in FIG. 5, the first transparent electrode 22 is formed as strips extending in the lateral direction of FIG. 5, a connecting terminal portion 22*a* is formed on one end of each of the strip electrodes 22 which are disposed parallel to one another and spaced at predetermined intervals along the vertical dimension of substrate 21, and the connecting terminal portions 22*a* extend to the end of the electrodes 22 so that they appear on both edges of the substrate 21 alternately on the right and left sides of the strip electrodes 22.

The second transparent electrodes 26 are formed as strips extending in the vertical direction of FIG. 5, a connecting terminal portion 26*a* is formed on one end of each of the strip electrodes 26 which are disposed parallel to one another and spaced apart at predetermined intervals along the lateral dimension of substrate 21, and the connecting terminal portions 26*a* extend to the end of the electrodes 26 so that they appear on the upper and lower edges of the substrate 21 alternately on the upper and lower sides of the strip electrodes 26.

The connecting terminal portions 22*a* are formed by coating a metallic film such as Ni or Au on the portions of the electrodes 22 which are not coated by the first insulating layer 23, luminescent layer 24 and second insulating layer 25, and by coating pre-solder on the metallic film, and the connecting terminal portions 26*a* are similarly formed on the electrodes 26.

On the other hand, as shown in FIG. 6, the thin-film EL element 1 is constructed by sequentially laminating on a non-alkali glass substrate 11 which is larger than the glass substrate 21 described above the following: a reflective first electrode 12 made from Ta, Mo or W metallic film; a first insulating layer 13; a luminescent layer 14 generating light having a second color which is different from the first color, a second insulating layer 15 and a second transparent electrode 16 made from a zinc oxide ($ZnO:Ga_2O_3$) transparent conductive film.

Figure 4:
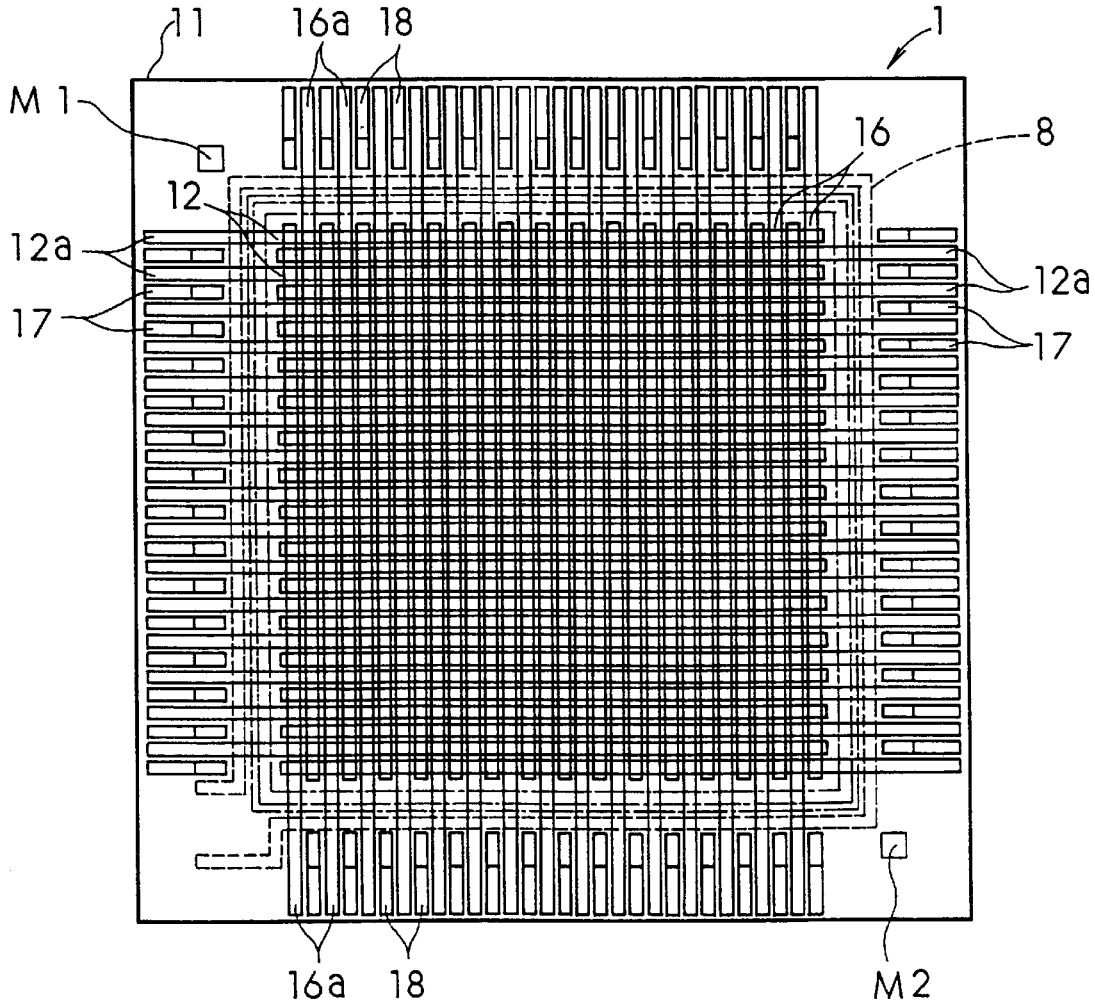
FIG. 4 is a schematic plan view of a thin-film EL display panel 1.

As shown in FIG. 4, the first transparent electrode 12 is formed as strips extending in the lateral direction of FIG. 4, connecting terminal portions 12*a* are formed on one end of each of strip electrodes 12 which are parallel to one another and spaced apart at predetermined intervals along the vertical dimension of the substrate, and the connecting terminal portions 12*a* extend to the ends of the electrodes so that they appear on both edges of the substrate 21 alternately on the right and left sides of the strip electrodes 12.

The second transparent electrodes 16 are formed as strips extending in the vertical direction of FIG. 4, connecting terminal portions 16*a* are formed on one end of each of the strip electrodes 16 which are parallel to one another and spaced apart at predetermined intervals along the lateral direction of the substrate 11, and the connecting terminal portions 16*a* extend to the ends of the electrodes so that they appear on the upper and lower edges of the substrate 21 alternately on the upper and lower sides of the strip electrodes 16.

In addition to that, connecting pad portions 17 and 18 for connecting the electrodes 22 and 26 on the side of the thin-film EL element 2 are formed at positions neighboring each of the connecting terminal portions 12*a* and 16*a*, respectively. Those connecting pad portions 17 are disposed to face the connecting terminal portions 22*a* of the electrodes 22 when the EL elements are laminated together, and the connecting pad portions 18 face the connecting terminal portions 26*a* of the electrodes 22 of the EL elements when the EL elements are laminated together. Those connecting pad portions 17 and 18 are formed by coating pre-solder on a metallic film such as Mi or Au.

Those two thin-film EL elements 1 and 2 are laminated and bonded by positioning them relative to one another so that the luminescent layers face each other, by keeping the gap between the substrates constant using adhesive 8 including a spacer and by registering positioning marks M1 and M2 printed on the substrates 11 and 21, respectively, in advance so that the positions of luminescent dots of each of the thin-film EL elements 1 and 2 accurately coincide; that is, so that the pixel rows formed by the dots are coplanar with one another in planes perpendicular to planes containing the substrates.

The pre-solder on the connecting pad portions 17 and 18 combine to become a conductive coupling section 19 when heated and melted. Each conductive coupling section 19 connects a corresponding connecting terminal portion 22*a* of the first transparent electrode 22 of the thin-film EL element 2 with its connecting pad portion 17 as shown in FIGS. 2 and 3, and the corresponding connecting terminal portion 26*a* of the second transparent electrode 26 with its connecting pad portion 18 not shown.

The adhesive 8 is applied along the inside of the connecting pad portions 17 and 18 and oil inlets are formed by not applying the adhesive at some portions. Silicon oil fills the gap between the elements 1 and 2 via the oil inlets and then the oil inlets are sealed using the adhesive 8.

The lead wires 7 such as FPCs are connected to the connecting terminal portions 12*a* and 16*a* and the connecting pad portions 17 and 18 formed on the upper edge portion of the substrate 11 of the thin-film EL element 1. The lead wires 7 are connected to a driving circuit (not shown).

Although a non-alkali glass substrate 11 has been used here as the substrate of the thin-film EL element 1 on the back, it need not necessarily be transparent, and a ceramic substrate such as mullite ($3Al_2O_3*2SiO_2$—$Al_2O_3*2SiO_2$) or alumina ($Al_2O_3$) may be used.

Similarly, although the first electrode 12 of the thin-film EL element 1 has been implemented as a reflective electrode made from Ta, Mo or W metallic film, it may be a transparent electrode made from a transparent conductive film such as ITO. When a transparent substrate and transparent electrode are used for the thin-film EL element 1 on the backside, a more prominent contrast can be made by disposing a black tape or heat resistant black paint on the back of the substrate 11. However, it is preferable to use a metallic electrode having a high reflectance if it is desirable to increase the brightness of the display.

Furthermore, for the reflective electrode, a high reflective metallic film such as Al and Ag may be used beside Ta, Mo or W. In selecting this high reflectivity metallic film, however, it is necessary to consider the consistency of coefficient of thermal expansion and film stress with other films such as the insulating film and components such as the substrate, and whether it is possible to sustain fabrication conditions required by such a film, such as the processing temperature. Although a high reflectance such as that obtained from Al cannot be expected with Ta, Mo or W, those materials meet the above conditions.

A method of fabricating the variable color thin-film EL display panel described above will be further explained below.

For the thin-film EL element 2, an ITO transparent conductive film was formed on the glass substrate 21 at a thickness of about 200 nm by DC sputtering within a mixed gas atmosphere of argon (Ar) and oxygen (O) and the strip transparent first electrodes 22 were formed while shifting every other electrode in the lateral direction in the figure by means of wet etching.

For the thin-film EL element 1, the Ta reflective electrode was formed on the glass substrate 11 at a thickness of about 150 nm by DC sputtering within an argon (Ar) gas atmosphere and the stripe and reflective first electrodes 12 were formed by dry etching and parts which correspond to the connecting terminal portion 12*a* were formed on end portions thereof.

On that, silicon oxide nitride (SiON) was formed at a thickness of about 100 nm by RF sputtering in a mixed gas atmosphere of argon, nitrogen and a small amount of oxygen by targeting on silicon and after that, the first insulating layer 13 was formed thereon by successively forming into a thickness of 300 nm by RF sputtering in a mixed gas atmosphere of argon and oxygen by targeting on a mixture of tantalum pentoxide and aluminum oxide ($Ta_2O_5$*$Al_2O_3$).

For the thin-film EL element 2, the luminescent layer 24 was then formed at a thickness of 500 nm by RF sputtering in a mixed gas atmosphere of argon and helium (He) by targeting on zinc sulfide (ZnS) on which TbOF was doped.

For the thin-film EL element 1, the luminescent layer 14 was formed at a thickness of 620 nm by an electron beam deposition method using zinc sulfide (ZnS) on which Mn was doped as pellets for deposition.

The second insulating layers 15 and 25 were formed by successively forming SiON into a thickness of 100 nm and $Ta_2O_5$*$Al_2O$ into a thickness of 320 nm in the same manner with the first insulating layers 13 and 23 and by forming, thereon, SiON into a thickness of 100 nm. Here, the film forming conditions of the first and second insulating layers are the same and the thickness was adjusted by a conveying speed and repeated number of times of the formation.

After forming and laminating those thin films, ZnO transparent conductive film in which $Ga_2O_3$ had been doped was formed at a thickness of 450 nm by means of ion plating and the stripe and transparent second transparent electrodes 26 which are shifted in the vertical direction in the figure per every other electrode were formed by a photo-etching method.

Meanwhile, as for the thin-film EL element 1, the stripe and transparent second transparent electrodes 16 were formed in the similar manner and the parts which correspond to the connecting pad portions 16*a* were formed on the end of the electrodes.

The first insulating layers 13 and 23, the luminescent layers 14 and 24 and the second insulating layers 15 and 25 were formed by restricting the circumference of the glass substrates 11 and 21 using a metallic mask or the like to avoid coating the end portions of the first electrodes 12 and first transparent electrodes 22. After that, the connecting terminal portions 12*a*, 16*a*, 22*a* and 26*a* were formed and the positioning marks M1 and M2 used when two substrates are laminated together were formed by covering the film forming areas of the first insulating layers 13 and 23, the luminescent layers 14 and 24 and the second insulating layers 15 and 25 and by restricting film forming areas at the predetermined positions at the end of the first electrodes 12 and 22 and second electrodes 16 and 26 around the glass substrates 11 and 21 by an open metallic mask, by forming a layer into a thickness of 350 nm by DC sputtering in an argon atmosphere by targeting on nickel (Ni) and by isolating each of the electrode terminal portions so that no connection is made between the terminals by means of wet etching.

The reason why the film forming areas of the first insulating layers 13 and 23, the luminescent layers 14 and 24 and the second insulating layers 15 and 25 were covered was to protect the above films including the second transparent electrodes 16 and 26 made of the Zno film in etching Ni and to cover the necessary parts by resist not to expose to a Ni etching solution.

In the thin-film EL element 1, a Ni film was formed on each of the connecting terminal portions 12*a* and 16*a* and connecting pad portions 17 and 18 of the first electrode and second transparent electrodes similar to the case described above, and the positioning mark M1 was formed at the corner of the substrate.

The thin-film EL elements 1 and 2 fabricated as described above were bonded and solidified by spreading and applying resin beads (not shown), each having a diameter of about 20 $\mu$m for forming the gap on the inside of the elements and by screen-printing the epoxy thermosetting resin adhesive 8 in which the resin beads as spacers are mixed in, by positioning the elements 1 and 2 accurately so that the misregistration stays within 5 $\mu$m by using the positioning marks M1 and M2 formed in advance on the substrates by the Ni film when the connecting terminal portions 12*a*, 16*a*, 22*a* and 26*a* were formed and by putting the assembly in a high temperature tank in a state in which the two substrates 11 and 21 are laminated so that the luminescent layers face one another.

The elements 1 and 2 are bonded and fixed at this time so that the connecting terminal portions 22*a* and 26*a* formed on the thin-film EL element 2 are exactly laminated with the connecting pad portions 17 and 18, i.e., the hatched portion in FIG. 1) formed on the thin-film EL element 1.

The silicon oil was introduced into the gap between the two substrates by soaking the elements 1 and 2 into the silicon oil under a vacuum atmosphere while keeping down the oil inlets where portions of the adhesive 8 are cut away and by returning the atmosphere to atmospheric pressure. After wiping out excess oil, the oil inlets were sealed by an epoxy cold setting resin adhesive. In sealing them, an ultraviolet setting adhesive may be used instead of the epoxy cold setting adhesive.

After that, the sealed elements 1 and 2 were soaked in a solder (alloy of Pb and Sn) plating tank to form a solder plating film having a thickness of about 10 μm on the connecting terminal portions 22*a* and 26*a* of the thin-film EL element 2 and on the connecting terminal portions 12*a* and 16*a* and the connecting pad portions 17 and 18 of the thin-film EL element 1.

Further, the connecting terminal portions 22*a* and 26*a* were heated from the light-emitting side of the thin-film EL element 2 by a non-contact heating technique such as a light beam to melt the solder, and the conductive coupling sections 19 were formed by the melted solder to connect to the connecting pad portions 17 and 18 formed on the thin-film EL element 1.

although the solder plating film was formed on the connecting terminal portions 12*a*, 16*a*, 22*a* and 26*a* after laminating the two substrates in the embodiment described above, it is possible to form the solder plating film at a predetermined position on the substrate in advance before the lamination or to form it by screen-printing pasted solder or by discharging and applying solder from a dispenser such as an injection needle.

For the solder, any solder may be used so long as it is paste-like in which conductive particles such as silver paste are kneaded into an organic solvent, has fluidity as heat is applied and solidifies and becomes conductive when cooled. However, it should not be one which damages the EL elements by fumes and gas generated when heated.

Although the light beam was used as the non-contact heating technique in melting the solder in the embodiment described above, a burner-type heating means which blows out hydrogen gas and oxygen gas from a very narrow nozzle and burns them or a dryer-type heating technique which blows out high temperature hot air may be used.

On the thin-film EL display panel fabricated as described above, the lead wires 7 such as FPCs are soldered to the connecting terminal portions 12*a* and 16*a* and the connecting pad portions 17 and 18 formed on the edge portion of the substrate 11 of the thin-film EL element 1, and the other end of the lead wires 7 are soldered to a printed board made of a glass epoxy on which a driving circuit and possibly other components are mounted. Then, the peripheral portion of the thin-film EL display panel is coated by an insulating silicon resin in order to protect those connecting parts.

An inspection after the fabrication process had been completed confirmed that the variable color thin-film EL display panel fabricated as described above has no faults due to soldering failures, presents no misregistration between the two thin-film EL elements 1 and 2 and no blur of the display pattern due to the optical path difference caused by the gap between the two elements; furthermore, it provides excellent displays.

Although a dot-matrix type thin-film EL display panel has been fabricated in the embodiment described above, a seven-segment numerical display panel or similar device may be similarly fabricated according to this aspect of the invention. Furthermore, colors of the thin-film EL elements other than those described above may be used, color filters may be provided as necessary and it is possible to increase the luminescent brightness of the display by laminating together two thin-film EL elements having the same luminescent color.

Figure 26:
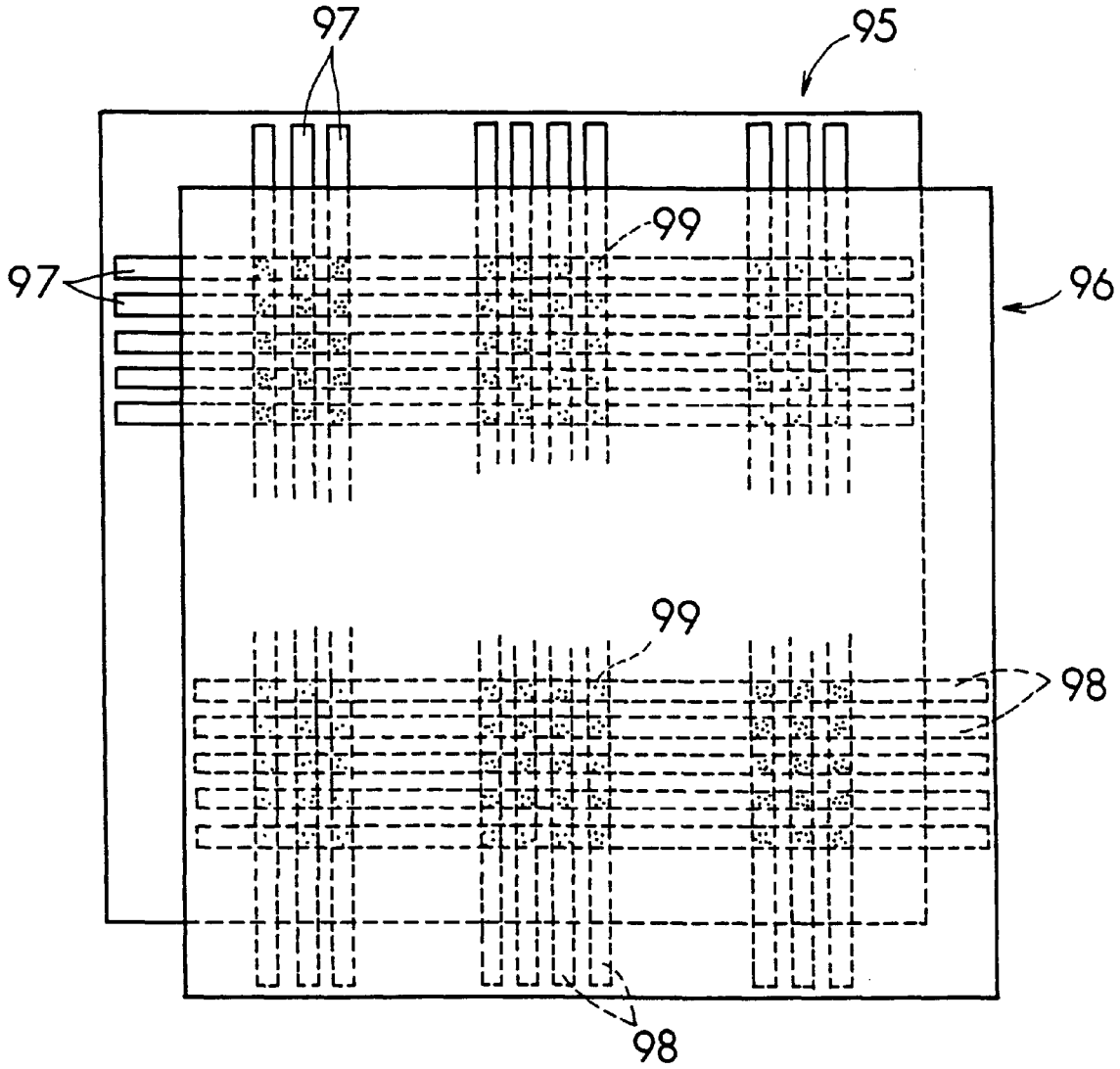
FIG. 26 is a schematic plan view of a dot matrix type thin-film EL display panel.

Because each electrode of the two thin-film EL elements 1 and 2 laminated at the same position is fed from both ends in the opposite directions via the lead wires in the thin-film EL display panel of the above-mentioned embodiment, the occurrence of the nonuniformity of brightness and color may be reduced as compared to the case when power is fed from only one side as shown in FIG. 26. However, if the display panel is enlarged and the area of the display screen increases, the nonuniformity of brightness and color becomes conspicuous since the length of each electrode becomes long, the electrical resistance of the electrode increases, and the capacitive load of picture elements increase due to an increase in the number of picture elements.

Figure 7:
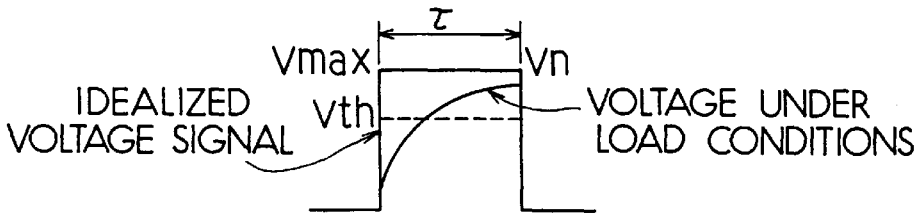
FIG. 7 is a waveform chart of a driving voltage of the thin-film EL display panel.

FIG. 7 shows waveforms of a voltage applied to each electrode of each thin-film EL element 1 and 2 and of a real voltage. While the voltage applied to the element is a rectangular pulse, the voltage actually applied to the electrode is a voltage having a transient characteristic as shown in the waveform of the real voltage.

Figure 8:
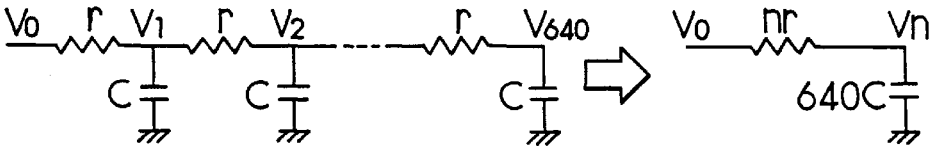
FIG. 8 is an equivalent circuit of one display line of a dot matrix thin-film EL display panel.

In FIG. 7, (τ) denotes a pulse width, (Vmax) a maximum applied (signal) voltage, (Vn) a maximum voltage applied to a real load (one picture element in the EL element) and (Vth) an emission starting voltage of the EL element. An equivalent circuit of the electrode on one line (X-axis) in the dot matrix type thin-film EL display panel may be represented by the simplified circuit shown in FIG. 8. A number of electrodes in the direction vertical to one line of electrodes (Y direction), i.e. a number of picture elements, is, for example, 640.

In this equivalent circuit, the maximum real voltage Vn applied to the n-th picture element may be expressed as:

$$Vn=V_{max}(1-e^{-t/640nRC})$$

where t is the period of time when the voltage is applied to one picture element in the EL element and is in a range of 0 to τ.

Because the brightness of the thin-film EL element becomes high in proportion to the voltage, the distribution of brightness may be estimated by finding the value of Vn. Because the thin-film EL element does not emit light unless the voltage increases more than the emission starting voltage Vth, the value of the expression $(Vn-Vth)/(V_{max}-Vth)$ is proportional to the distribution of brightness in the display.

Figure 9:
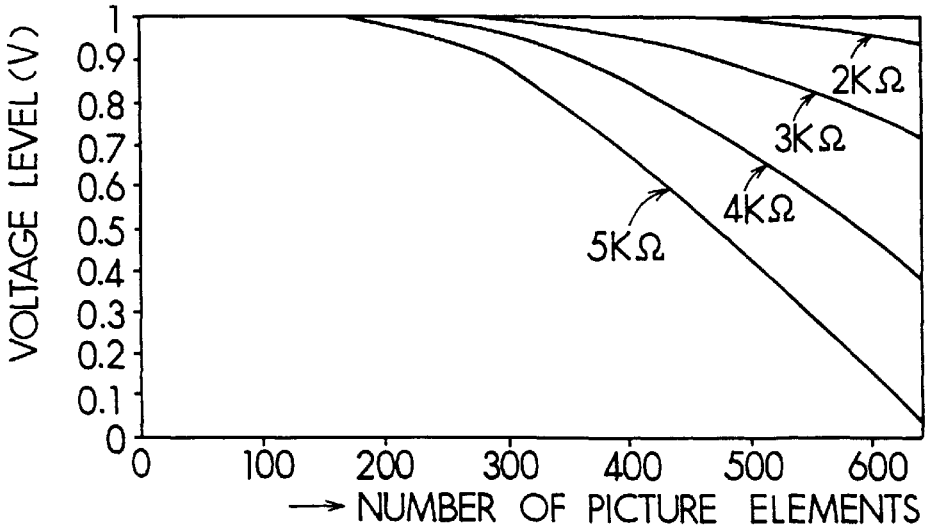
FIG. 9 is a graph showing voltage applied to each picture element.

FIG. 9 is a graph of the brightness distribution of brightness of one line of electrodes (X direction) of the display panel simulated based on the equations described above and shows results calculated by determining the resistance values nr from the connecting terminal portion to individual picture elements by assuming the pulse width τ=35 microseconds, capacitance C of one picture element=6 pF, Vmax=300 V and Vth=250 V, assuming the total resistance value R (variously) to be 5 kΩ, 4 kΩ, 3 kΩ and 2 kΩ and assuming that the electrode resistance value between picture elements r and the total resistance value R has a relationship of R=640 r. As seen from FIG. 9, when the electrode resistance increases, the voltage drops, i.e. the nonuniformity of brightness becomes more significant.

Figure 10:
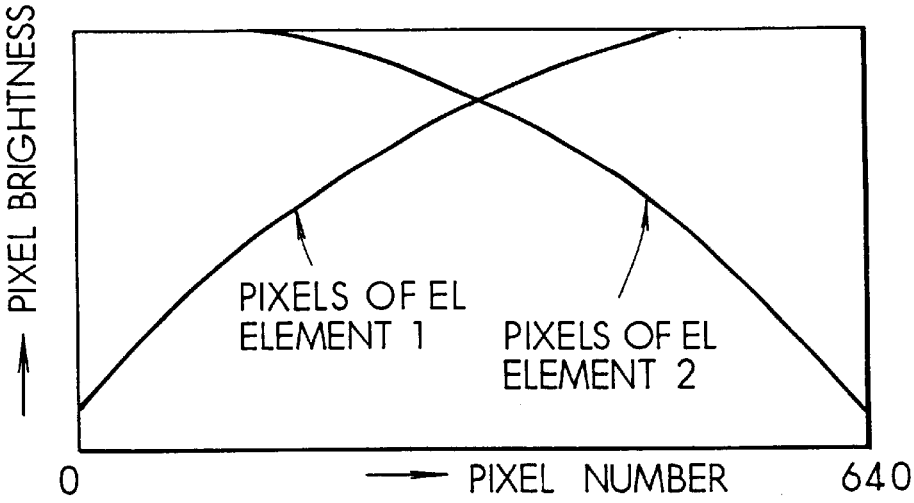
FIG. 10 is a graph showing a relationship between the number of picture elements and brightness of the dot matrix thin-film EL display panel.

FIG. 10 shows the brightness of one line when the thin-film EL elements 1 and 2 having an electrode resistance R=5 kΩ, for examples are laminated together. As can be seen in the graph, although the nonuniformity of brightness is eliminated when the luminescent color of the thin-film EL elements 1 and 2 is the sane because they supplement one another, nonuniformity of color is likely to occur when the elements have different luminescent colors because the brightness of both elements change differently along the line.

In other words, assume an electrode 12 on the lower EL element 1 is driven from the right side of FIG. 1 so that the pixels connected thereto produce a brightness profile as shown in the corresponding graph trace of FIG. 10, and an electrode 22 on the upper EL element 2 is driven from the left side of FIG. 1 so that the pixels connected thereto produce a brightness profile as shown in the other graph trace of FIG. 10. If the lower EL element 1 produces green light and the upper EL element 2 produces orange light, then the overall color generated in the display will be as follows:

| | VOLTAGE | | |
|---|---|---|---|
| | Left | Middle | Right |
| Element 1 | Low | Medium | High |
| Element 2 | High | Medium | Low |
| Composite | Green | Yellow | Orange |

Thus, since the voltage gradients along the upper electrode 22 and on the lower electrode 12 are opposite to one another, a single composite display color cannot usually be obtained.

FIGS, 11 though 15 show a second embodiment of the present invention which exemplifies a thin-film EL display panel which can reduce the nonuniformity in multi-color displays as described above.

Figure 14:
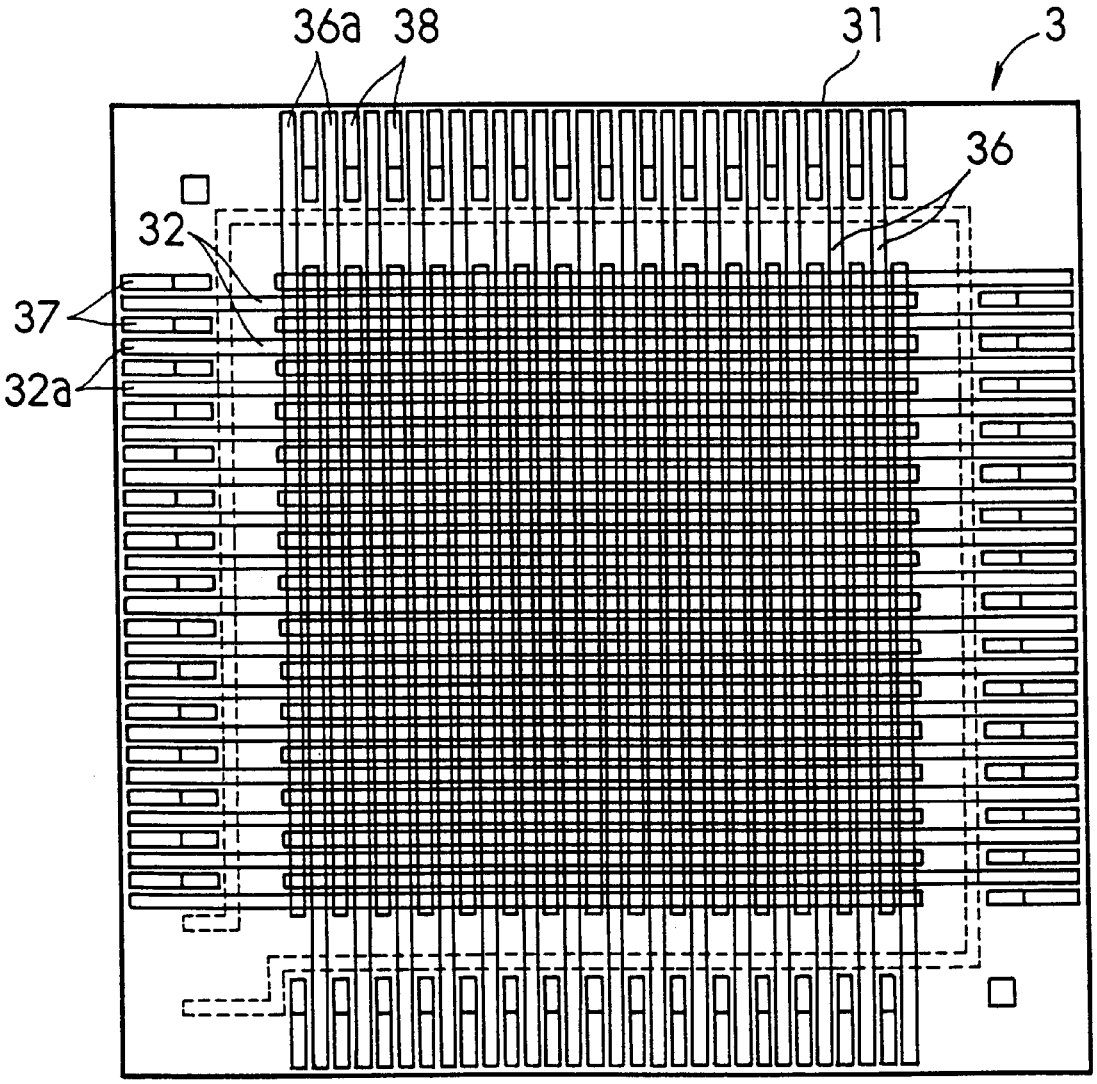
FIG. 14 is a schematic plan view of a thin-film EL display panel 3.

This thin-film EL display panel is constructed by laminating and bonding a smaller thin-film EL element 4 (FIG. 15) on a thin-film EL element 3 shown in FIG. 14 while facing their luminescent layers together. The thin-film EL element 4 is constructed by sequentially laminating on a non-alkali glass substrate 41 the following: a first transparent electrode 42 made from a transparent conductive film, a first insulating layer, a luminescent layer whose base material is zinc sulfide (ZnS) and which generates a first luminescent color, a second insulting layer and a second transparent electrode 46.

Figure 15:
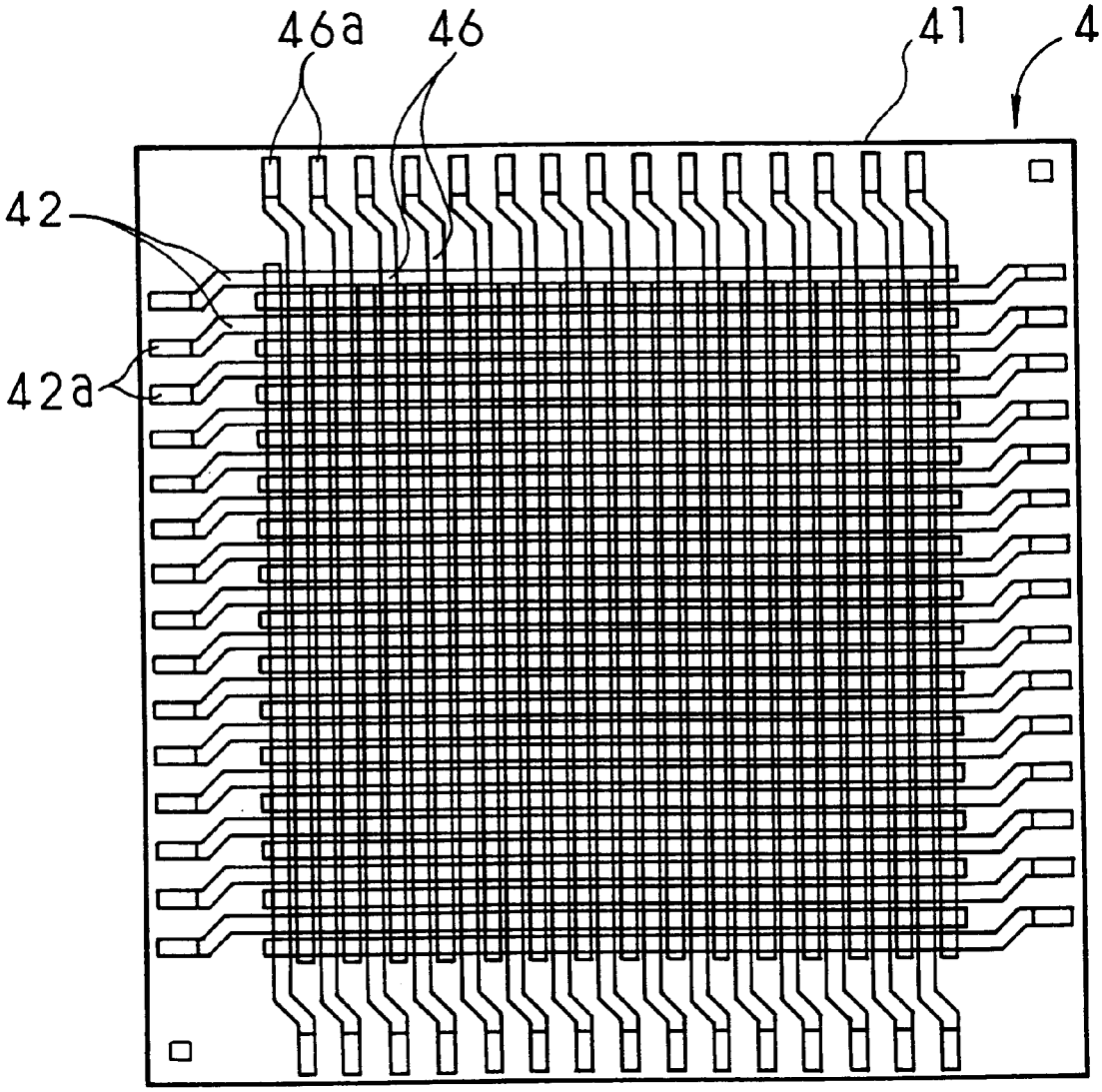
FIG. 15 is a schematic plan view of a thin-film EL display panel 4.
Figure 16:
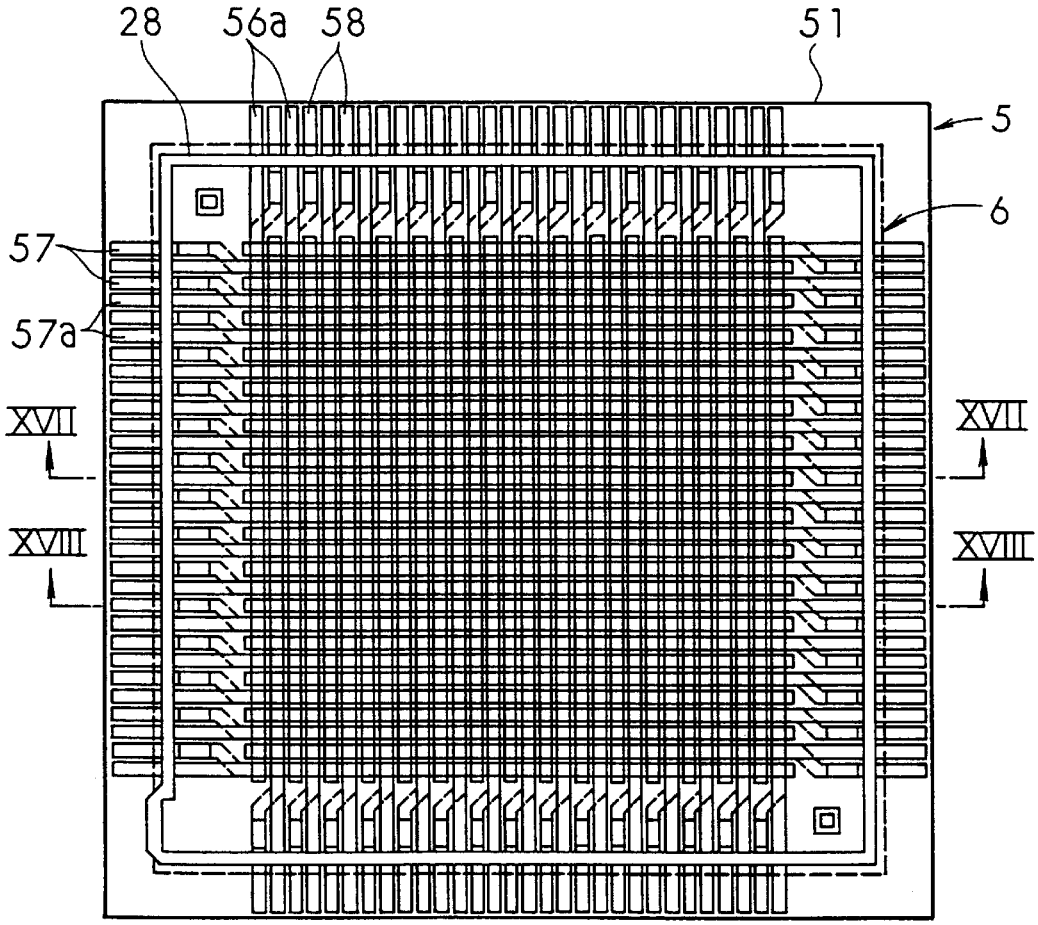
FIG. 16 is a schematic plan view of a thin-film EL display panel according to a third embodiment of the present invention.

As shown in FIG. 15, the first transparent electrode 42 is formed in strips extending in the lateral direction of FIG. 15, connecting terminal portions 42*a* are formed on one end of a large number of strip electrodes 42 disposed in parallel at predetermined intervals and the connecting terminal portions 42*a* extend to the ends of the electrodes so that they appear on both edges or the substrate 41 alternately on the right and left sides of every other terminal and so that they are bent toward the neighboring electrode. That is, each of the connecting terminal portions 42*a* is positioned on the line of the next electrode 42. The second transparent electrodes 46 are formed as strips extending in the vertical direction or FIG. 15, a connecting terminal portion 46*a* is formed on one end of a large number of strip electrodes 42 disposed in parallel at predetermined intervals and the connecting terminal portions 46*a* extend to the ends of the electrodes so that they appear on the upper and lower edges of the substrate 41 alternately alternately on the upper and lower sides of every other terminal and so that they are bent toward the neighboring electrode. That is, each of the connecting terminal portions 46*a* is positioned on the line of the neighboring electrode 46.

On the other hand, as shown in FIG. 14, the thin-film EL element 3 is constructed by sequentially laminating on a non-alkali glass substrate 31 the following: a reflective first electrode 32, a first insulating layer, a luminescent layer generating a second luminescent color which io different from the first luminescent color, a second insulating layer and a second transparent electrode 36.

As shown in FIG. 14, the first electrode 32 is formed as strips extending in the lateral direction of FIG. 14, a connecting terminal portion 32*a* is formed on one end of a large number of strip electrodes 32 which are parallel to one another and spaced apart at predetermined intervals from one another along the vertical dimension of the substrate, and the connecting terminal portions 32*a* extend to the ends of the electrodes so that they appear on both edges of the substrate 41 alternately on the right and left sides of every other terminal.

The second transparent electrodes 36 are formed as strips extending in the vertical direction, a connecting terminal portion 36*a* is formed on one end of a large number of strip electrodes 36 which are parallel to one another and spaced apart at predetermined intervals along the lateral dimension of the substrate, and the connecting terminal portions 36*a* extend to the ends of the electrodes so that they appear on the upper and lower edges of the substrate 31 alternately on the upper and lower sides of every other terminal.

In addition, connecting pad portions 37 and 38 for connecting the electrodes 42 and 46 on the side of the thin-film EL element 4 are formed at positions neighboring each of the connecting terminal portions 32*a* and 36*a*. Those connecting pad portions 37 are positioned facing the connecting terminal portions 42*a* of the electrode 42 when both EL elements are laminated together, and the connecting pad portions 38 are positioned facing the connecting terminal portions 46*a* of the electrode 46 when both EL elements are laminated together. Those connecting pad portions 37 and 38 are formed by coating pre-solder on a metallic film such as Ni or Au.

Figure 11:
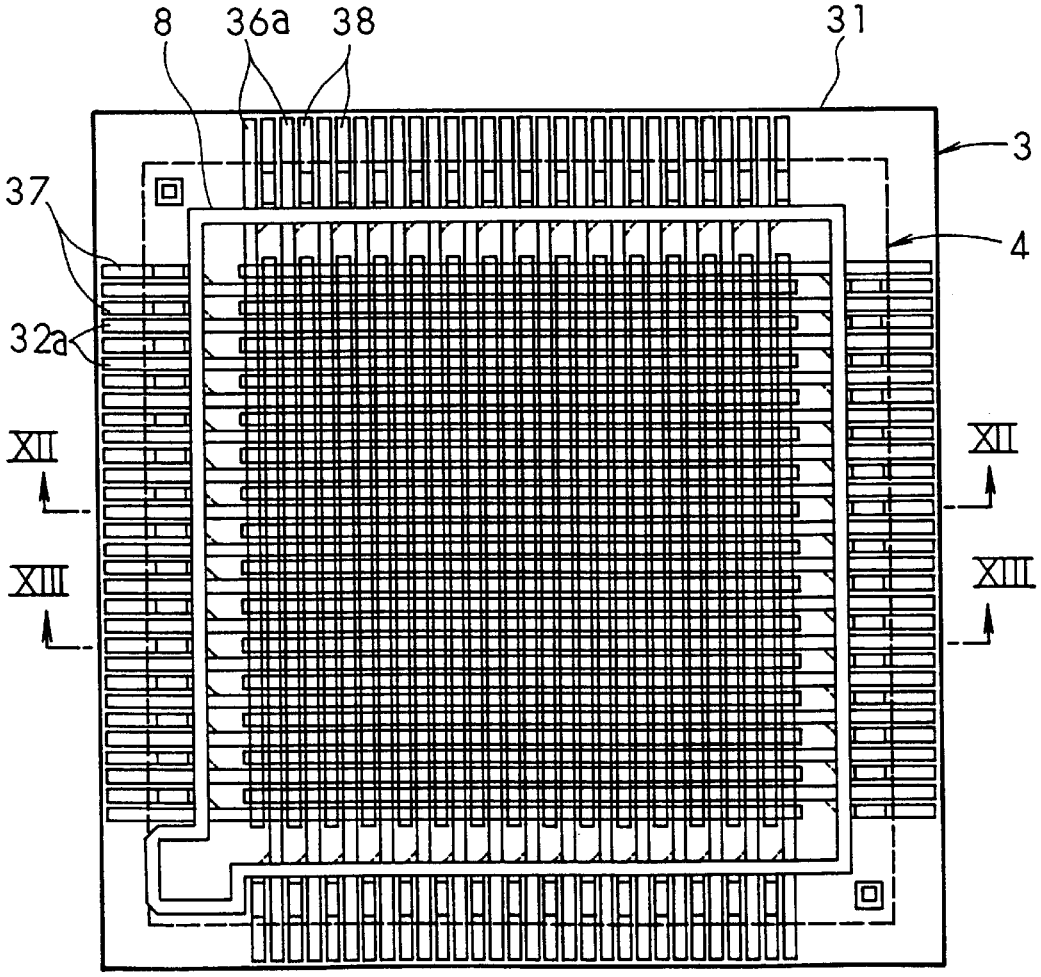
FIG. 11 is a schematic plan view of a thin-film EL display panel according to a second embodiment of the present invention.
Figure 12:
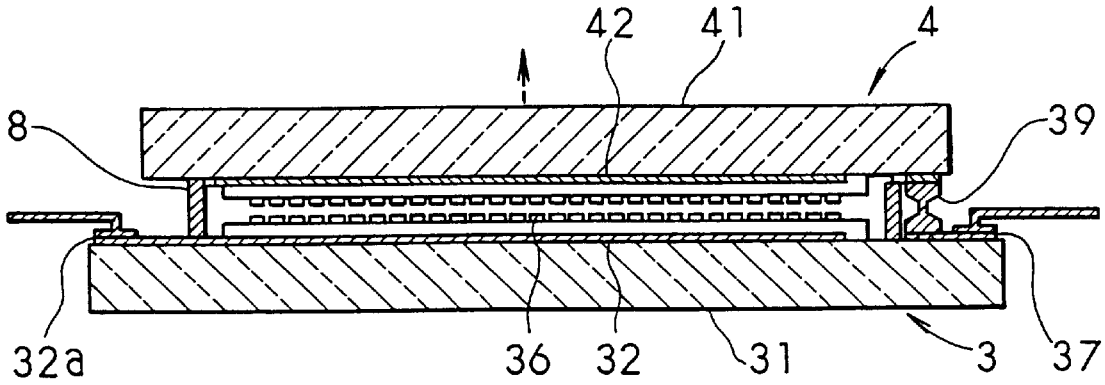
FIG. 12 is a schematic cross-sectional view along a line XII—XII in FIG. 11.
Figure 13:
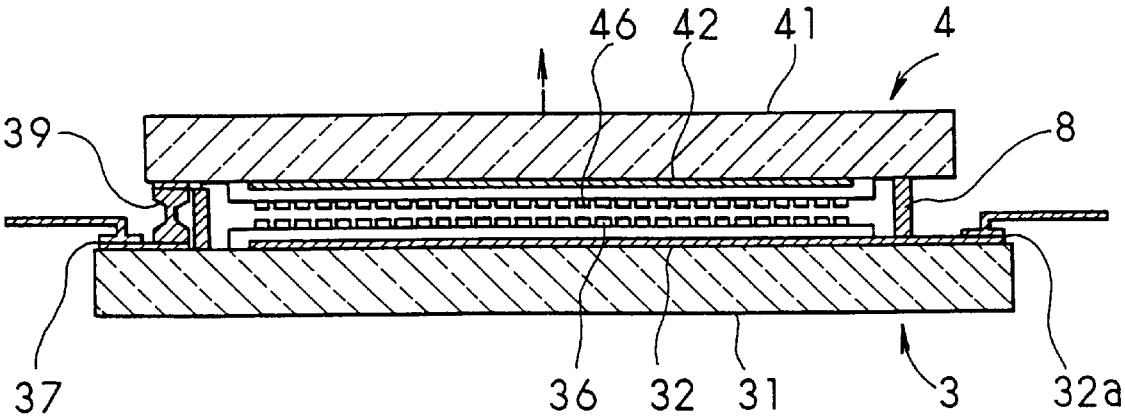
FIG. 13 is a schematic cross-sectional view along a line XIII—XIII in FIG. 11.

Those two thin-film EL elements 3 and 4 are laminated and bonded together by disposing them so that the luminescent layers face each other, keeping the gap between the substrates constant using adhesive 8 including spacers as described above, and by registering positioning marks formed on the substrates in advance so that the positions of luminescent dots of each of the thin-film EL elements 3 and 4 accurately coincide with one another. As shown in FIGS. 11 through 13, the adhesive 8 surrounds the display section along the inside of each of the connecting terminal portions 32*a* and 36*a* and the connecting pad portions 37 and 38.

The pre-solder on the connecting pad portions 37 and 38 becomes a conductive coupling section 39 when it is heated and melted. The conductive coupling section 39 connects the connecting terminal portion 42*a* of the first transparent electrode 42 of the thin-film EL element 4 with the connecting pad portion 37, and it connects the connecting terminal portion 46*a* of the second transparent electrode 46 with the connecting pad portion 38 as shown in FIGS. 12 and 13.

In the thin-film EL display panel constructed as described above, the connecting terminal portions 42*a* and 46*a* of the first and second transparent electrodes 42 and 46 of the thin-film EL element 4 are disposed by being bent toward the neighboring electrode as shown in FIG. 15, so that when both thin-film EL elements 3 and 4 are laminated and bonded, each of the electrodes 42 and 32 or electrodes 46 and 36 of both thin-film EL elements 3 and 4 located in the same display position are connected to the connecting terminal portions 32*a* and 36*a* or connecting pad portions 37 and 38 provided on the same side.

Accordingly, because each of the electrodes 42 and 32 or electrodes 46 and 36 on the same display position are fed from the same direction when driven and the brightness decreases in the same direction because each of the electrodes 42 and 32 or electrodes 46 and 36 on the same display position are fed from the same direction when driven and the brightness decreases in the same direction on one display line, the nonuniformity of color caused by the phenomenon shown in FIG. 10 of the above-mentioned embodiment will not come about.

That is, assume an electrode 32 on the lower EL element 3 and an electrode 42 on the upper EL element 4 are both driven from the right side of FIG. 11 so that the pixels connected to each of the electrodes 32 and 42 produce a brightness profile similar to the trace of electrode 22 of EL element 2 as shown in FIG. 10. If the lower EL element 3 produces green light and the upper EL element 4 produces orange light, then the overall color generated in the display will be as follows:

| | VOLTAGE | | |
|---|---|---|---|
| | Left | Middle | Right |
| Element 1 | Low | Medium | High |
| Element 2 | Low | Medium | High |
| Composite | Yellow | Yellow | Yellow |

Thus since the voltage gradients along the upper electrode 42 and on the lower electrode 32 generally track one another, the composite color along the pixel electrodes is uniform.

Even though the composite color along the pixel electrodes is uniform in this embodiment, the voltage gradients may cause the brightness along the rows to change gradually—for example, in the above example, it is likely that the overall display brightness decreases from right to left. To avoid this problem, alternating rows on each element are preferably driven from opposite ends, so that alternating rows of superimposed electrodes 32 and 42 have opposed brightness profiles. In this way, the brightnesses from neighboring lines tend to balance one another, thereby making the overall brightness more uniform.

In other words, the brightness decreases the farther from the side closer to the connecting terminal portion and connecting pad portion a picture element is, it is possible to cause the nonuniformity of brightness not to be perceived by human eyes because the hue is the same and the brightness is inverted on the neighboring display line and the decrease of the brightness on each display line nay be supplemented by other lines.

FIGS. 16 through 20 show a third embodiment of the present invention. In this embodiment, banding of both thin-film EL elements 5 and 6 is made by an adhesive 28 disposed along the outside of the connecting parts of the connecting terminal portions 62*a* and 66*a* of each electrode of a thin-film EL element 6 on the side emitting light with the connecting pad portions 57 and 58. Other structures are almost the same with those of the second embodiment described above.

Figure 19:
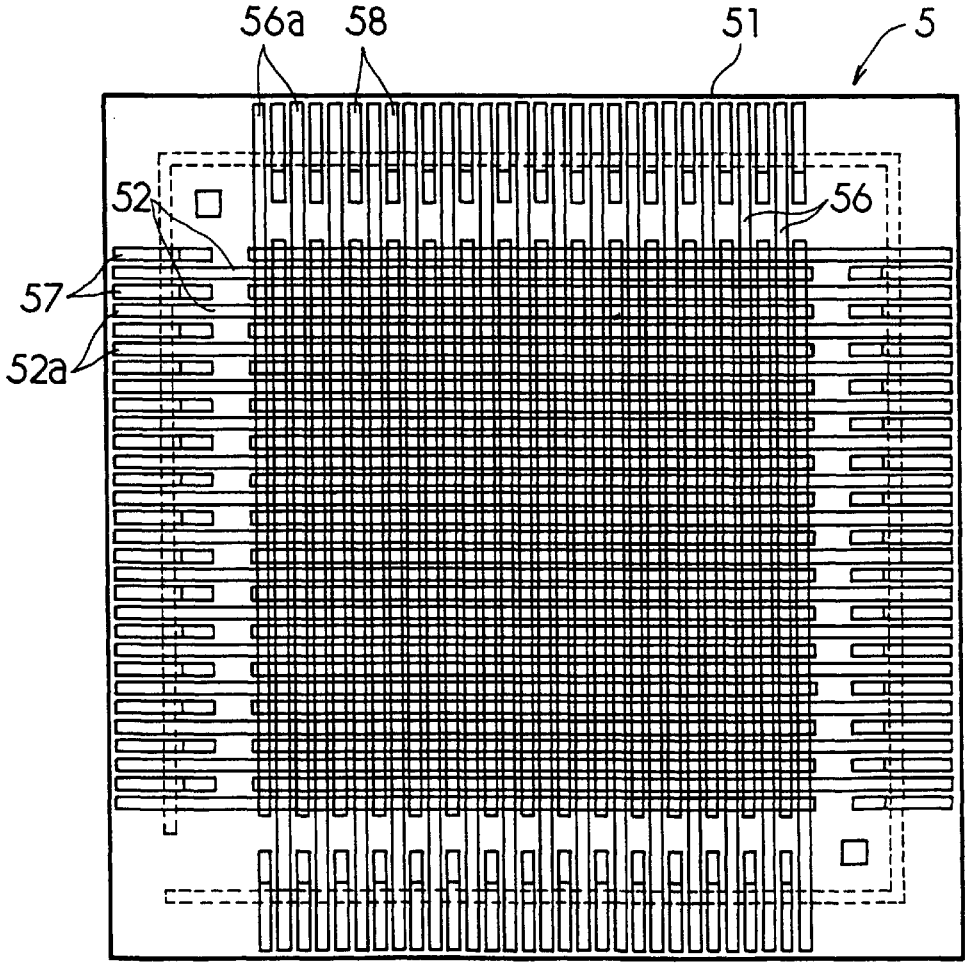
FIG. 19 is a schematic plan view of a thin-film EL display panel 5.
Figure 20:
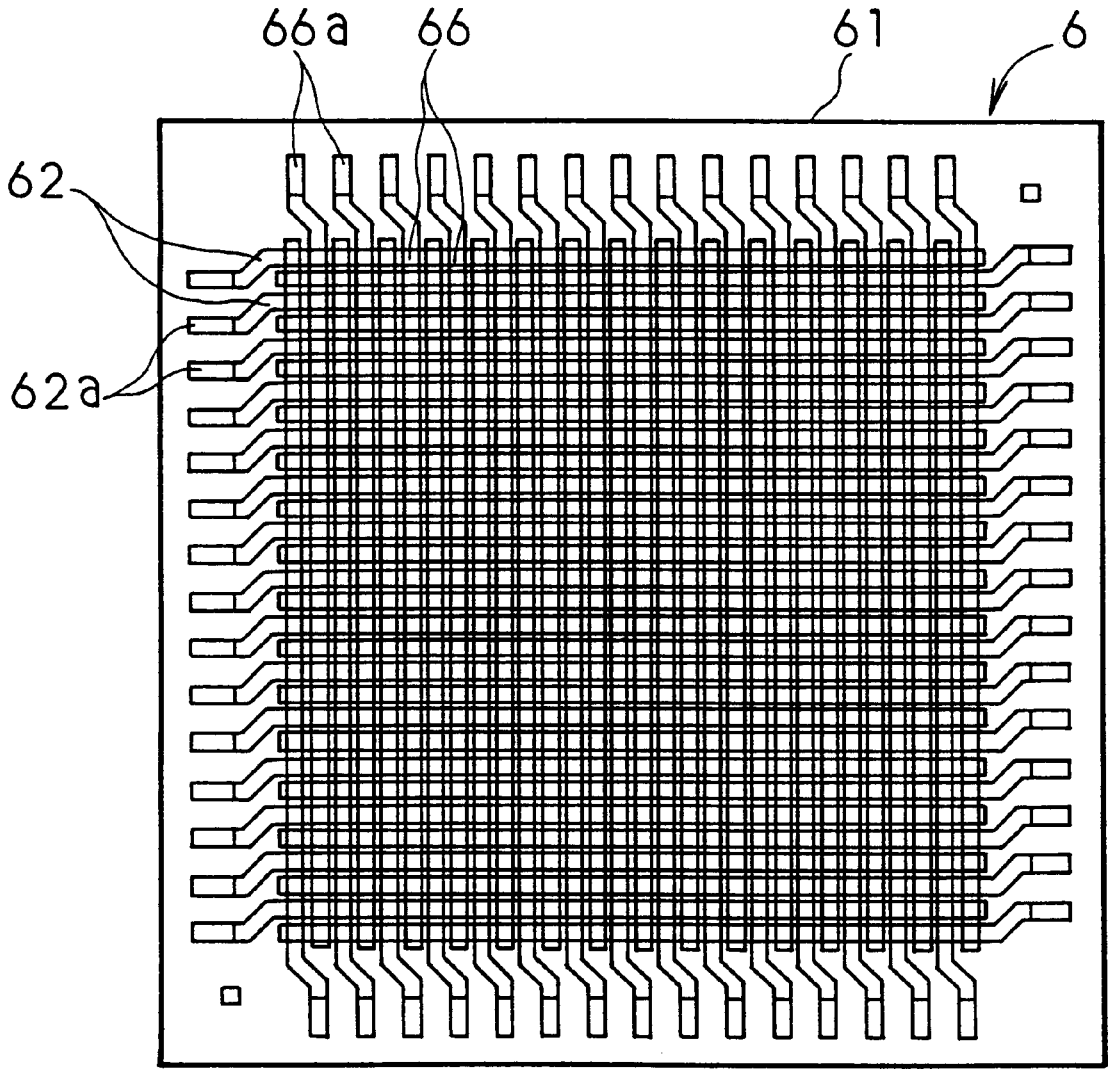
FIG. 20 is a schematic plan view of a thin-film EL display panel 6.

Similarly to the above-described embodiment, this thin-film EL display panel is constructed by laminating the smaller thin-film EL element 6 (shown in FIG. 20) on a thin-film EL element 5 shown in FIG. 19 while their luminescent layers face one another, wherein display light is emitted toward the thin-film EL element 6 to be a display face.

While the thin-film EL elements 5 and 6 are constructed basically similarly to the thin-film EL elements 3 and 4 in the above-mentioned embodiment, a space for placing the adhesive 28 is provided at the periphery of a glass substrate 61 in the thin-film EL element 6 and a space for placing the adhesive 28 is provided on the outside of the parts of the connecting pad portions 57 and 58 and the connecting terminal portions 52*a* and 56*a* (the part where the connecting terminal portions 62*a* and 66*a* on the side of the thin-film EL element 6 are connected) in the thin-film EL element 5.

The two thin-film EL elements 5 and 6 are bonded by the adhesive 28 while forming a solder plating film on the connecting terminal portions 52*a*, 56*a*, 62*a* and 66*a* of each electrode and the connecting pad portions 57 and 58 and while accurately positioning the elements 5 and 6 by disposing the adhesive 28 including spacers as described above along the outside of the connecting parts of the connecting terminal portions 62*a* and 66*a* of each electrode with the connecting pad portions 57 and 58.

Figure 17:
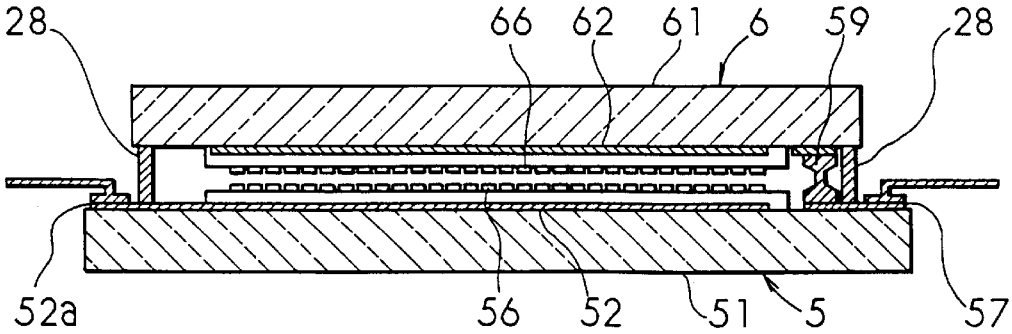
FIG. 17 is a schematic cross-sectional view along a line XVII—XVII in FIG. 16.
Figure 18:
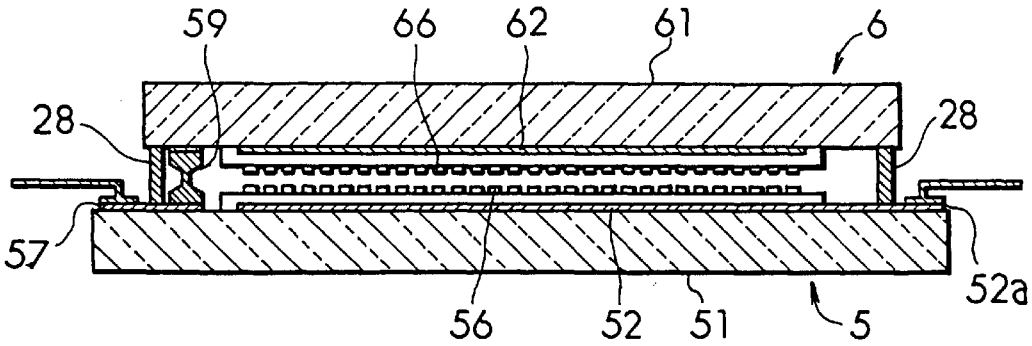
FIG. 18 is a schematic cross-sectional view along a line XVIII—XVIII in FIG. 16.

The pre-solder on the connecting pad portions 57 and 58 becomes conductive coupling sections 59. Those conductive coupling sections 59 connect the connecting terminal portions 62*a* of the first transparent electrodes 62 of the thin-film EL element 6 with the connecting pad portions 57, and they connect the connecting terminal portions 66*a* of the second transparent electrodes 66 with the connecting pad portions 58 as shown in FIGS. 17 and 18.

More specifically, the bonding of the thin-film EL elements 5 and 6 and the connection of the connecting pad portions 57 and 58 through the conductive coupling section 59 are performed as follows.

Because the solder plating film cannot be formed on the connecting terminal portions and connecting pad portions after laminating the two thin-film EL elements 5 and 6, the solder plating film is formed by screen-printing paste solder (super solder) at a predetermined position on the substrate in advance of the lamination process. The thickness of the applied solder was about 10 $\mu$m on each element and the elements 5 and 6 almost contacted each other when they were laminated.

A light beam then irradiated the connecting parts of the connecting terminal portions 52*a*, 56*a*, 62*a* and 66*a* and the connecting pad portions 57 and 58 through the transparent substrate 62 to heat up those parts to melt the solder and to couple the parts by the conductive coupling section 59 made of melted solder.

Silicon oil was filled into the gap between the two thin-film EL elements 5 and 6 by soaking them in silicon oil under a vacuum atmosphere while immersing the oil inlets where portions of the adhesive 28 are cut away and by returning the atmosphere to atmospheric pressure. After wiping away excess oil, the oil inlets were sealed with an epoxy cold setting adhesive. If necessary, any silicon oil remaining at this time can be completely removed by carrying in a final cleaning step.

Similar to the first embodiment, lead wires such as FPC were connected to the connecting terminal portions 52*a* and 56*a* formed on the periphery of the glass substrate 51 of the thin-film EL element 5 and to the connecting pad portions 57 and 58, and the periphery of the glass substrate 51 was coated by an insulating silicon resin or the like in order to protect those connecting parts.

In the thin-film EL display panel fabricated as described above, because the conductive coupling sections 59 are located inside of the area sealed by the adhesive 28, those parts can be well-protected. Furthermore, because only silicon oil at the part of the connecting terminal portions and connecting pad portions (except in the area around the conductive coupling sections 59) need be removed when removing silicon oil adheres to the connecting terminal portions and the like in the fabrication process, the oil removing work may be readily performed. Moreover, because the lead wires can be connected to the connecting terminal portions and connecting pad portions after filling the insulating oil and sealing the assembly, the packaging operation can be simplified in comparison with prior art processes.

Figure 21:
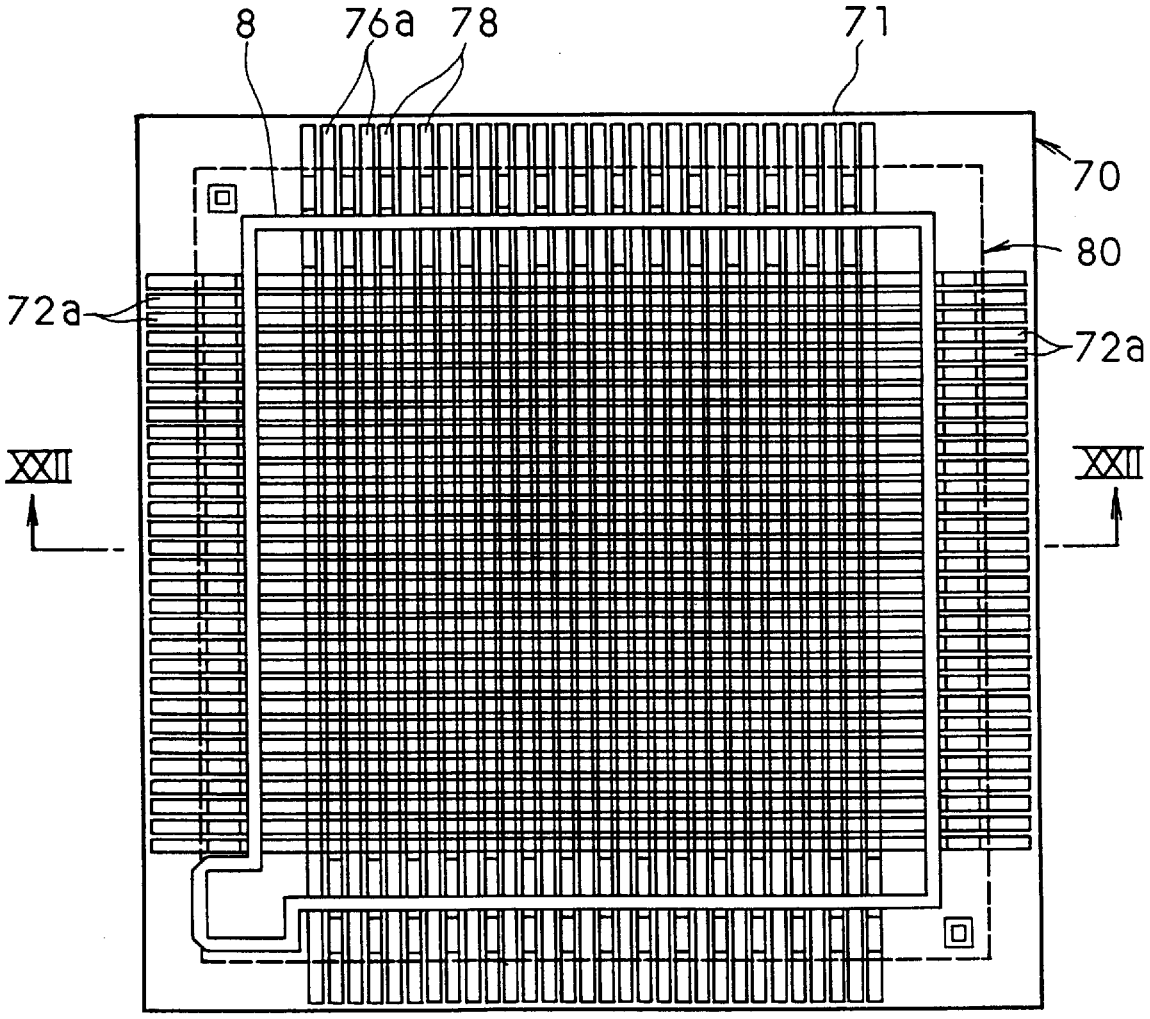
FIG. 21 is a schematic plan view of a thin-film EL display panel according to a fourth embodiment of the present invention.

FIGS. 21 though 24 show a fourth embodiment of the present invention which exemplifies a thin-film EL display panel in which the structure of the connecting terminal portion of the electrode is even further simplified and which permits common connection of the scan side electrodes of each element to a driving circuit.

This thin-film EL display panel is constructed by laminating and bonding a smaller thin-film EL element 80 (shown in FIG. 24) on a thin-film EL element 70 shown in FIG. 21.

The thin-film EL element 80 is constructed by sequentially laminating on a glass substrate 81 the following: a first transparent electrode 82 made from a transparent conductive film, a first insulating layer, a luminescent layer whose base material is zinc sulfide (ZnS) and which generates a first color, a second insulating layer and a second transparent electrode 86, similar to the one described above.

Figure 24:
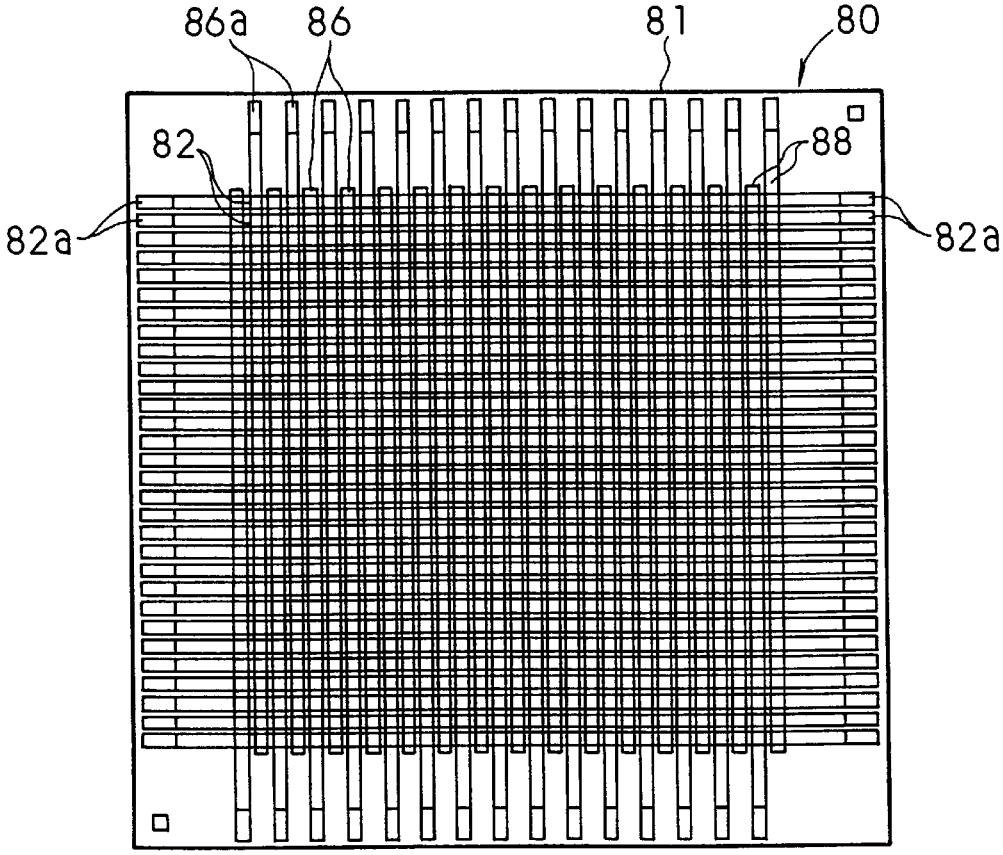
FIG. 24 is a schematic plan view of a thin-film EL display panel 80.
Figure 25:
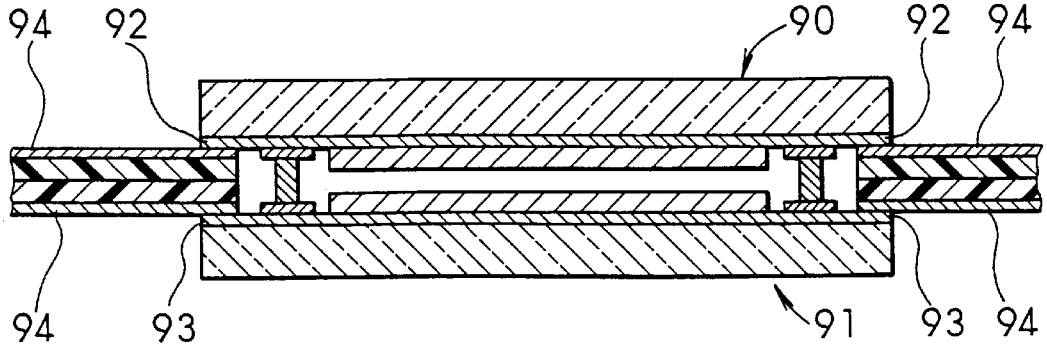
FIG. 25 PRIOR ART
FIG. 25 is a schematic section view of a prior art thin-film EL display panel.

As shown in FIG. 24, the first transparent electrode 82 is formed as stripes extending in the lateral direction of FIG. 24, and a connecting terminal portion 82*a* is formed on one end of a large number of strip electrodes 82 disposed in parallel at predetermined intervals. The second transparent electrodes 86 are formed as strips extending in the vertical direction of FIG. 24, a connecting terminal portion 86*a* is formed on one end of a large number of strip electrodes 82 disposed in parallel at predetermined intervals, and the connecting terminal portions 86*a* extend so that they appear on the upper and lower edges of the substrate 81 alternately on the upper and lower sides of every other terminal.

Figure 23:
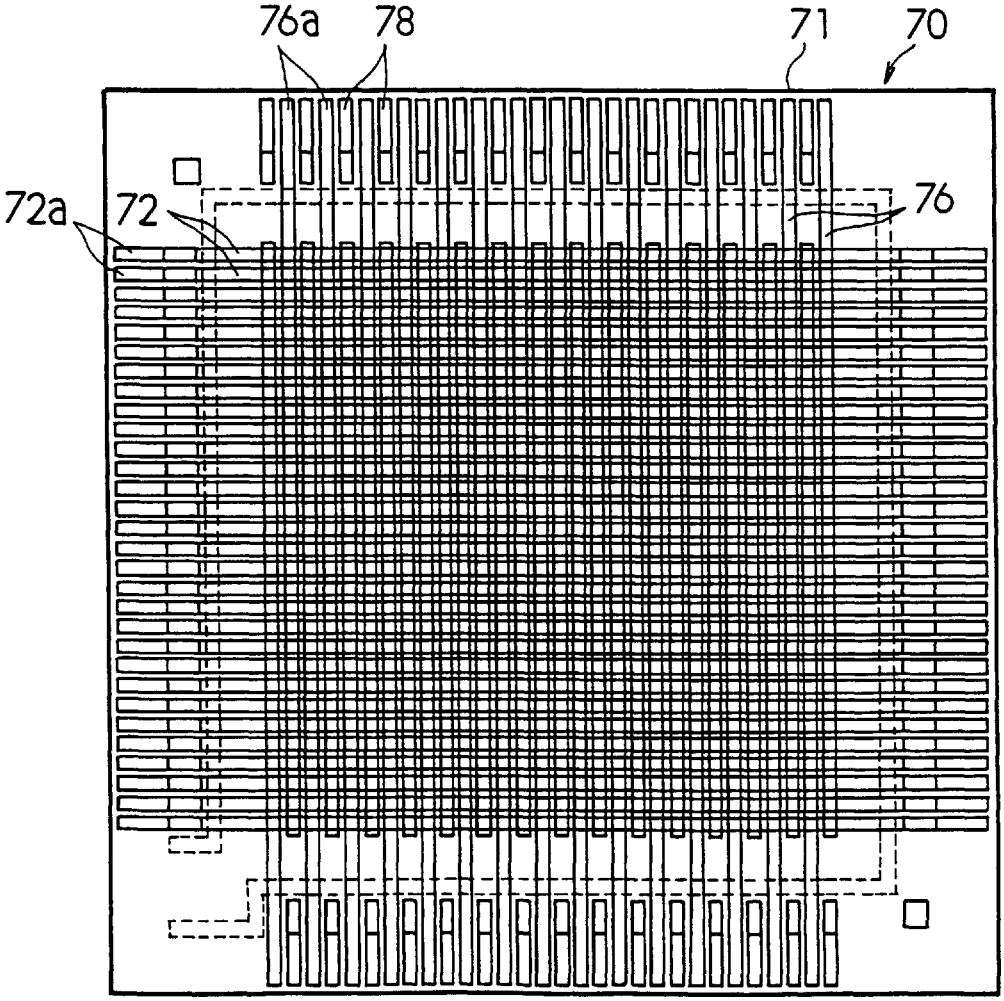
FIG. 23 is a schematic plan view of a thin-film EL display panel 70.

On the other hand, as shown in FIG. 23, the thin-film EL element 70 is constructed by sequentially laminating on a glass substrate 71 the following: a reflective first electrode 72, a first insulating layer, a luminescent layer generating a second luminescent color which is different from the first luminescent color, a second insulating layer and a second transparent electrode 76 made from a transparent conductive film.

As shown in FIG. 23, the first electrode 72 is formed as strips extending in the lateral direction of FIG. 23, and a connecting terminal portion 72*a* is formed on both ends of strip electrodes 72 which are parallel to one another and spaced apart at predetermined intervals along the vertical dimension of the substrate. The second transparent electrodes 76 are formed as strips extending in the vertical direction of FIG. 23, a connecting terminal portion 76*a* is formed on one end of strip electrodes 76 parallel to one another and spaced apart at predetermined intervals along the lateral dimension of the substrate, and the connecting terminal portions 76*a* extend to the end of the electrodes so that they appear on the upper and lower edges of the substrate 71 alternately on the upper and lower sides of every other terminal.

In addition, connecting pad portions 77 and 78 for connecting the electrodes 82 and 86 on the side of the thin-film EL element 80 are formed at positions neighboring each of the connecting terminal portions 72*a* and 76*a*. Those connecting pad portions 78 face the connecting terminal portions 86*a* of the electrode 86 when both EL elements are laminated together. Those connecting pad portions 78 are formed by coating pre-solder on a metallic film such as Ni or Au.

Those two thin-film EL elements 70 and 80 are laminated and bonded together by disposing them so that the luminescent layers face one another, by keeping the gap between the substrates constant using adhesive 8 including spacers as described above, and by registering positioning marks printed on the substrates in advance so that the positions of luminescent dots of each of the thin-film EL elements 70 and 80 accurately coincide.

Figure 22:
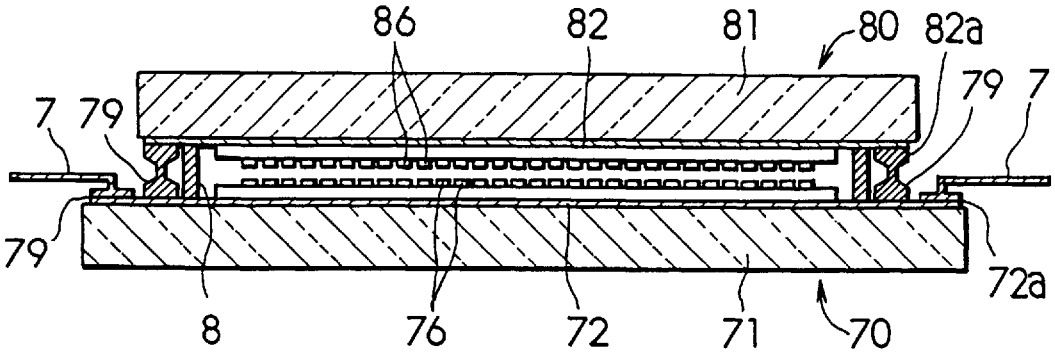
FIG. 22 is a schematic section view along a line XXII—XXII in FIG. 21.

Pre-solder on the connecting terminal portions 82*a* and 86*a* and on the connecting pad portions 38 becomes conductive coupling sections 79 when heated and melted. As shown in FIG. 22, each conductive coupling section 79 couples the connecting terminal portion 82*a* of the first transparent electrode 82 of the thin-film EL element 80 with the connecting terminal portion 72*a* of the first transparent electrode 72 of the thin-film EL element 70 on the row side (scan side) electrode and couples the connecting terminal portion 86*a* of the second transparent electrode 86 of the 80 with the connecting pad portion 78 on the column side (signal side) electrode.

In the thin-film EL display panel constructed as described above, the connecting terminal portions 72*a* and 82*a* provided on both sides of the electrodes 72 and 82 on the same display line (lateral direction) of both thin-film EL elements 70 and 80 are mutually connected by the conductive coupling section 79 and the connecting terminal portion 86*a* is connected to the connecting pad portion 78 at the corresponding position via the conductive coupling section 79 on the electrodes 76 and 86 on the display line in the vertical direction as shown in FIGS. 21 and 22.

When such a thin-film EL display panel is driven, the scan side output of the driving circuit is connected to the connecting terminal portions 72*a* on both sides of the row side via the lead wire 7 such as an FPC, and the signal side output of the driving circuit is connected to the connecting terminal portion 76*a* and the connecting pad portion 78 on the column side via the lead wires.

A thin-film EL display panel constructed as described above allows common use of the driving circuit and lowers the cost of the device because the scan side electrodes of both thin-film EL elements 70 and 80 are commonly connected. Furthermore, because both ends of the first electrode on both sides of the same display line are short-circuited and connected to the driving circuit on the row side, power can be fed and display can be made continuously even if a disconnection occurs at any point on the electrode.

While the straight connecting terminal portions 76*a* and 86*a* are provided alternately at the ends of the neighboring electrodes of the second transparent electrodes 76 and 86 of the present embodiment, similarly to the first embodiment a drive voltage applied to the second transparent electrodes 76 and 86 on the column side, i.e., the signal electrodes, is low in comparison with that of the first electrode of the scan electrode, so that the nonuniformity of brightness and color described with reference to FIGS. 7 through 10 is reduced, thereby causing fewer problems in practice.

Although the dot matrix type thin-film EL display panel has been discussed in the embodiments described above, the present invention is also applicable to a seven-segment numerical indicator, and to similar devices as well.

Further, although the glass substrate of the thin-film EL element on the side emitting light has been formed to be smaller than the substrate of the element on the back side at the embodiments described above, it may be formed to be larger than the element on the back side.

Still further, it is possible to create the space for the connecting terminal portions on the edge of one substrate by forming the substrates of both thin-film EL elements in the same size and by laminating them while shifting the two substrates obliquely. It is also possible to laminate two rectangular substrates by turning them 90 degrees from each other so that both edges project to create the space for the connecting terminal portions on the projected edges.

What is claimed is:

1. An electroluminescent display panel comprising:

a first planar luminescent element having a plurality of first electrical contacts and a plurality of connecting pads;

a second planar luminescent element having a plurality of second electrical contacts; and connecting means for electrically connecting said plurality of second electrical contacts to corresponding ones of said plurality of connecting pads, thereby providing electrical connections for said pluralities of first and second electrical contacts in a plane of said first luminescent element.

2. The panel of claim 1, wherein said plane of said first luminescent element is different from a plane of said second luminescent element.

3. The panel of claim 1, wherein said plurality of second electrical contacts are connected to a corresponding plurality of second electrodes and are collinear with longitudinal axes of said corresponding plurality of second electrodes.

4. The panel of claim 1, wherein one of said plurality of second electrical contacts is connected to a first one of a plurality of second electrodes and is collinear with a longitudinal axis of a second one of said plurality of second electrodes, said first one and said second one of said plurality of second electrodes being adjacent to each other.

5. An electroluminescent display panel comprising:

a first element including a first plurality of first luminescent rows, said first plurality of first luminescent rows having luminosities which gradually increase from a first side of said panel to a second side of said panel; and a second element including a first plurality of second luminescent rows, said first plurality of second luminescent rows having luminosities which gradually decrease from said first side to said second side.

6. A panel according to claim 5, wherein said first luminescent rows are coplanar with corresponding ones of said second luminescent rows.

7. A panel according to claim 1, wherein:

said first element includes a second plurality of first luminescent elements, said second plurality of first luminescent rows having luminosities which gradually decrease from said first side to said second side;

said second element includes a second plurality of second luminescent rows, said second plurality of second luminescent rows having luminosities which gradually increase from said first side to said second side;

luminescent rows in said first plurality of first luminescent rows are coplanar with corresponding ones of said second plurality of second luminescent rows; and luminescent rows in said second plurality of first luminescent rows are coplanar with corresponding ones of said first plurality of second luminescent rows.

8. The panel of claim 7, wherein:

electrodes in said first and second pluralities of first luminescent rows alternate with one another on said first element; and electrodes in said first and second pluralities of second luminescent rows alternate with one another on said second element.

9. A panel according to claim 5, wherein a portion of said first element overlaps with a portion of said second element.

10. An electroluminescent display panel comprising:

a first element including a first plurality of luminescent rows on a surface thereof;

a second element including a second plurality of luminescent rows; and means for driving corresponding ones of said first and second pluralities of luminescent rows from opposite ends of the display panel in a direction parallel to said surface of said first element.

11. An electroluminescent display panel comprising:

a first element including a first plurality of luminescent rows;

a second element including a second plurality of luminescent rows each facing a corresponding one of said first plurality of luminescent rows; and means for driving a first pair of said first and second pluralities of luminescent rows facing each other from a first end of one of said first and second elements, and for driving a second pair of said first and second plurality of luminescent rows facing each other and adjacent to said first pair from a second end of said one of first and second elements, said second end being on an opposite side of said first and second plurality of luminescent rows from a first end in a direction parallel to said first and second elements.

12. An electroluminescent display panel comprising:

a first element having a first plurality of first luminescent rows, and a second plurality of first luminescent rows alternating with said first plurality of first luminescent rows, said first plurality of first luminescent rows respectively having electrodes at ends thereof on a first side of said panel to provide luminosities which gradually decrease from said first side to a second side of said panel, said second plurality of first luminescent rows respectively having electrodes at ends thereof on said second side to provide luminosities which gradually decrease from said second side to said first side; and a second element at least partially overlapping with said first element and having a first plurality of second luminescent rows and a second plurality of second luminescent rows, said first plurality of second luminescent rows respectively having electrodes at ends thereof on said first side to provide luminosities which gradually decrease from said first side to said second side, said second plurality of second luminescent rows respectively having electrodes at ends thereof on said second side to provide luminosities which gradually decrease from said second side to said first side;

wherein rows in said first plurality of first luminescent rows and corresponding rows in said second plurality of second luminescent rows are coplanar with one another to overlap and offset changes in luminosity therebetween; and rows in said second plurality of first luminescent rows and corresponding rows in said first plurality of second luminescent rows are coplanar with one another to overlap and offset changes in luminosity therebetween.

13. An electroluminescent display panel comprising:

a first element having a first plurality of first luminescent rows, and a second plurality of first luminescent rows alternating with said first plurality of first luminescent rows, said first plurality of first luminescent rows respectively having electrodes at ends thereof on a first side of said panel to provide luminosities which gradually decrease from said first side to a second side of said panel, said second plurality of first luminescent rows respectively having electrodes at ends thereof on said second side to provide luminosities which gradually decrease from said second side to said first side;

a second element at least partially overlapping with said first element and having a first plurality of second luminescent rows and a second plurality of second luminescent rows, said first plurality of second luminescent rows respectively having electrodes at ends thereof on said first side to provide luminosities which gradually decrease from said first side to said second side, said second plurality of second luminescent rows respectively having electrodes at ends thereof on said second side to provide luminosities which gradually decrease from said second side to said first side;

wherein rows in said first plurality of first luminescent rows and corresponding rows in said first plurality of second luminescent rows are coplanar to overlap with one another; and rows in said second plurality of first luminescent rows and corresponding rows in said second plurality of second luminescent rows are coplanar to overlap with one another and to offset changes in luminosity between a first overlapping pair of one of said second plurality of first luminescent rows and a corresponding one of said second plurality of second luminescent rows, and a second overlapping pair of a row in said first plurality of first luminescent rows and a corresponding row in said first plurality of second luminescent rows, said first and second overlapping pairs of rows being adjacent to one another.

14. A panel according to claim 13, wherein:

said first and second plurality of first luminescent rows each are for emitting light having a first color; and said first and second plurality of second luminescent rows each are for emitting light having a second color different from said first color.

15. An electroluminescent display panel comprising:

a first element having a first plurality of first luminescent rows, and a second plurality of first luminescent rows alternating with said first plurality of first luminescent rows, said first plurality of first luminescent rows respectively having electrodes at ends thereof on a first side of said panel to provide luminosities which gradually decrease from said first side to a second side of said panel, said second plurality of first luminescent rows respectively having electrodes at ends thereof on said second side to provide luminosities which gradually decrease from said second side to said first side;

a second element at least partially overlapping with said first element and having a first plurality of second luminescent rows and a second plurality of second luminescent rows, said first plurality of second luminescent rows respectively having electrodes at ends thereof on said first side to provide luminosities which gradually decrease from said first side to said second side, said second plurality of second luminescent rows respectively having electrodes at ends thereof on said second side to provide luminosities which gradually decrease from said second side to said first side;

wherein rows in said first plurality of first luminescent rows and corresponding rows in said first plurality of second luminescent rows are coplanar to overlap with one another; and rows in said second plurality of first luminescent rows and corresponding rows in said second plurality of second luminescent rows are coplanar to overlap with one another.

* * * * *